US007828377B2

(12) United States Patent
Grace

(10) Patent No.: US 7,828,377 B2
(45) Date of Patent: Nov. 9, 2010

(54) COLLAPSIBLE ARTICLES OF FURNITURE

(76) Inventor: Daniel R. Grace, 4 Beach Rd., Old Saybrook, CT (US) 06475

( * ) Notice: Subject to any disclaimer, the term of this patent is extended or adjusted under 35 U.S.C. 154(b) by 221 days.

(21) Appl. No.: 11/729,098

(22) Filed: Mar. 28, 2007

(65) Prior Publication Data

US 2007/0228780 A1 Oct. 4, 2007

Related U.S. Application Data

(60) Provisional application No. 60/786,480, filed on Mar. 28, 2006.

(51) Int. Cl.
*A47C 4/00* (2006.01)
*A47C 1/00* (2006.01)

(52) U.S. Cl. ..... 297/42; 297/47; 297/16.2; 297/344.18

(58) Field of Classification Search ..... 297/42, 297/45, 46–47, 56, 16.1–16.2, 344.18, 452.2; 403/52, 59, 62, 83, 112, 113
See application file for complete search history.

(56) References Cited

U.S. PATENT DOCUMENTS 2,669,289 A * 2/1954 Usher et al. ..... 248/436
4,045,045 A * 8/1977 Boucher et al. ..... 280/87.051
4,258,951 A * 3/1981 Groom ..... 297/16.2
4,544,203 A * 10/1985 Younger et al. ..... 297/45
4,714,224 A * 12/1987 Calmes ..... 248/465
4,775,182 A * 10/1988 von Hoffman ..... 297/45
4,904,018 A * 2/1990 Young ..... 297/4
4,934,638 A * 6/1990 Davis ..... 248/164
5,029,795 A * 7/1991 Dexter ..... 248/431
5,429,413 A * 7/1995 Levy et al. ..... 297/45
5,522,642 A * 6/1996 Herzog ..... 297/344.18
5,845,962 A * 12/1998 Lin ..... 297/54
5,876,091 A * 3/1999 Chernomashentsev ..... 297/16.2
6,206,462 B1 * 3/2001 Huang ..... 297/39
6,471,288 B2 * 10/2002 Alexander, Jr. ..... 297/344.18
6,634,704 B1 * 10/2003 Bergquist ..... 297/16.2
6,687,928 B1 * 2/2004 Wilson ..... 5/99.1
6,722,618 B1 * 4/2004 Wu ..... 248/166
7,073,860 B2 7/2006 Markus

* cited by examiner

*Primary Examiner*—David Dunn
*Assistant Examiner*—Erika Garrett

(57) ABSTRACT

Articles of furniture having a collapsible frame including a support assembly having a pair of collapsible longitudinally extending members coupled for angular movement about a pivot axis between open and closed positions and movable transversely of and through the axis between extended and retracted positions. Also includes mechanism for releasably securing each of the members in extended position and for preventing angular movement of the members from the closed to the open position when either and both of the members are out of extended position.

32 Claims, 23 Drawing Sheets

COLLAPSIBLE ARTICLES OF FURNITURE

CROSS REFERENCE TO RELATED APPLICATION

This application relates to Provisional U.S. patent application Ser. No. 60/786,480 filed Mar. 28, 2006, the filing date of which is hereby claimed and which application is hereby adopted by reference as part of the present disclosure.

BACKGROUND OF THE INVENTION

Popularity of the mini van, the sport utility vehicle (SUV) and the recreational vehicle has resulted in increased demand for improved collapsible furniture and particularly collapsible portable furniture of the outdoor type which may be readily stowed in a vehicle and conveniently manually transported to a picnic area or the site of a spectator event, as, for example, a golf tournament, air show, outdoor concert or sporting event where bring your own seating accommodation is the rule. Considerable attention has been directed to the provision of improved collapsible furniture for the sportsman, hunter, fisherman, hiker, biker and the like. However, the resulting furniture designs and particularly the designs for chairs and seats have usually incorporated some reduction in size, as compared to the full-sized article, with a corresponding reduction in the level of seating comfort. The wooden beach chairs and lawn furniture of an earlier era has generally been replaced by light-weight tubular metal furniture of a more modern design. However, little has been done to optimize the collapsibility and portability of the full-sized article, which is the goal of the present invention.

SUMMARY OF THE INVENTION

In accordance with the present invention, collapsible portable articles of furniture are provided which have a collapsible frame including at least one pair of longitudinally extending frame members. Each of the members has at least two longitudinally extending sections connected each to another for longitudinal movement relative to each other between retracted and extended positions. The frame further includes means for coupling the members of the at least one pair for angular movement relative to each other about a common unintruding axis which intersects the members between the opposite ends thereof. At least one of the members of each of the sections is freely movable transversely through the axis in traveling between its extended and retracted positions.

DETAILED DESCRIPTION OF PREFERRED EMBODIMENTS

Figure 1:
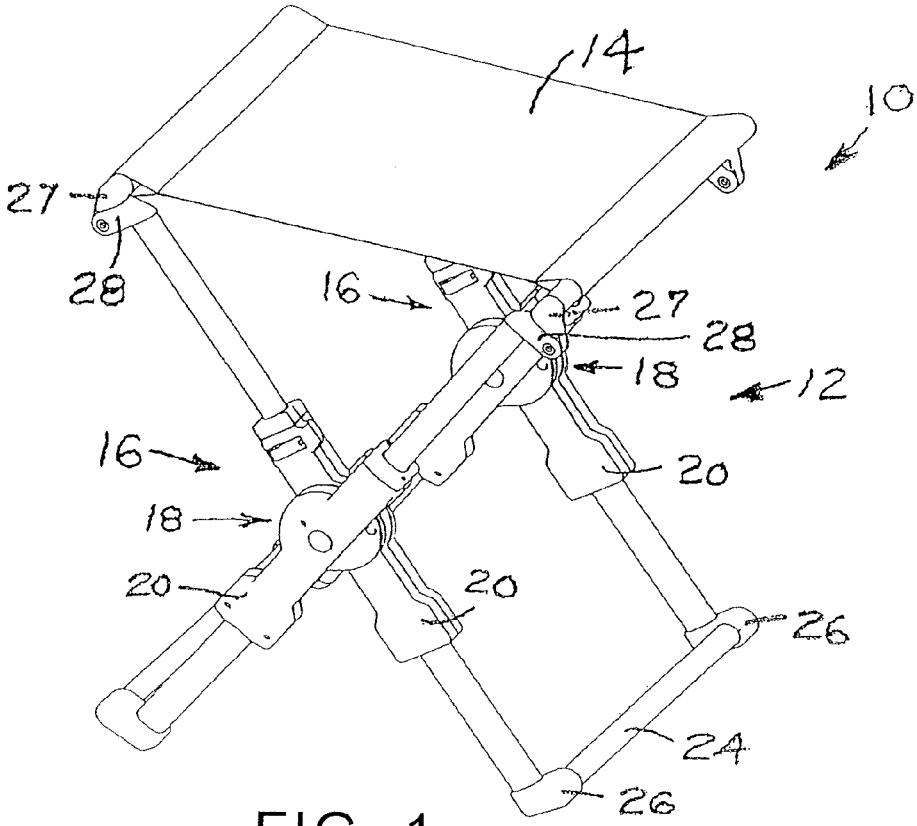
FIG. 1 is a perspective view of a collapsible four-legged stool embodying the invention and shown in set-up condition.

In the drawings and the descriptions which follow, the present invention is illustrated and described with reference to various collapsible articles of furniture embodying the invention. In this specification and in the claims, relative terms such as "upper", "lower", "front", "rear", "longitudinal", and "transverse" are employed for convenience of description and refer to the various structures in the orientations in which these structures appear in the drawings. However, it should be understood that the various supporting structures and the mechanisms hereinafter described may be utilized in any orientation.

Figure 2:
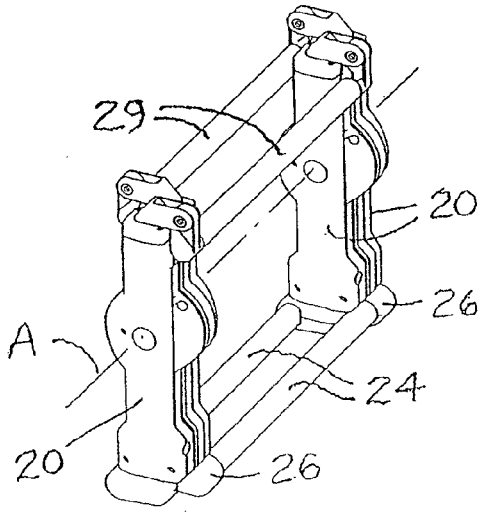
FIG. 2 is a perspective view of the stool frame shown in collapsed condition.
Figure 6:
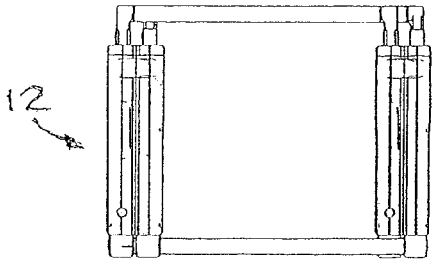
FIG. 6 is a side elevational view of the stool frame shown in collapsed condition.
Figure 7:
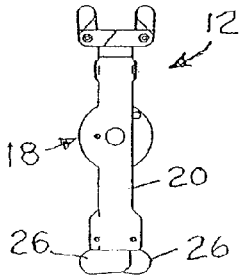
FIG. 7 is a front elevational view of the collapsed stool frame.

Turning now to the drawings and referring first particularly to FIGS. 1-7, a collapsible four legged stool of cross-legged type and embodying the present invention is designated generally by the reference number 10. The illustrated stool 10 essentially comprises a collapsible supporting structure or frame indicted generally at 12 which forms the base of the stool and supports a generally rectangular flexible fabric seat panel 14 in a horizontally disposed position when the stool 10 is in its setup or open position ready for use as it appears in FIGS. 1 and 3-5. In FIGS. 2, 6 and 7 the stool frame 12 is shown without the seat panel connected to it and in collapsible condition as will be hereinafter further discussed.

The frame 12 is formed by identical front and rear support assemblies 16, 16. Each support assembly 16 has a centrally located pivot or hub assembly 18 formed by a pair of identical hollow pivot housings or hubs 20, 20 coupled, each to the other, for limited angular movement about a common unintruding virtual axis of rotation designated by the letter A. Each support assembly 16 has a pair of longitudinally elongated collapsible support or leg members 22, 22. Each leg member 22 is mounted in an associated one of the pivot housings 20, 20, substantially as shown in the drawings. Thus, each pivot assembly 18 supports a pair of leg members 22, 22 for angular movement relative to each other and about the common axis of rotation A defined by an associated pivot assembly 18.

Figure 3:
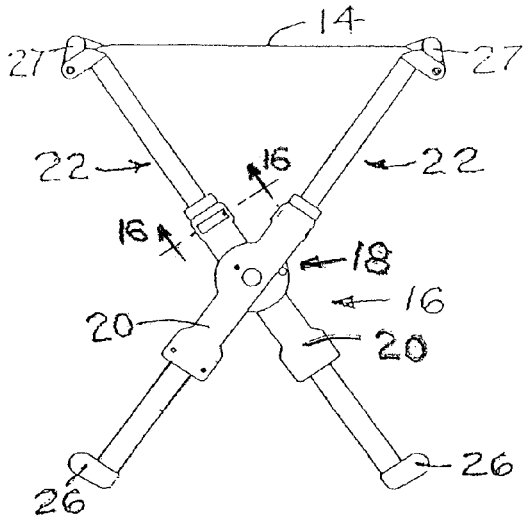
FIG. 3 is a front elevational view of the stool shown in set-up condition.
Figure 5:
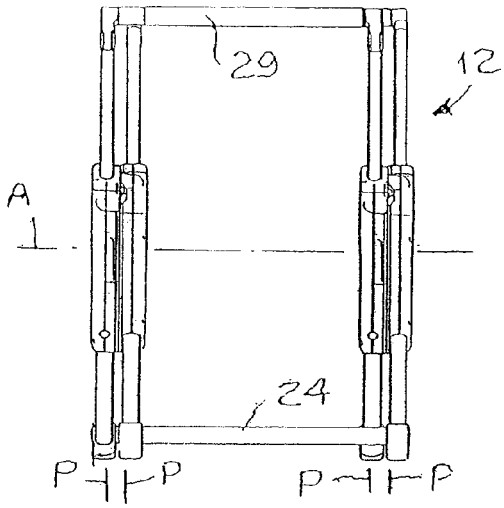
FIG. 5 is a side elevational view of the stool in set-up condition.
Figure 4:
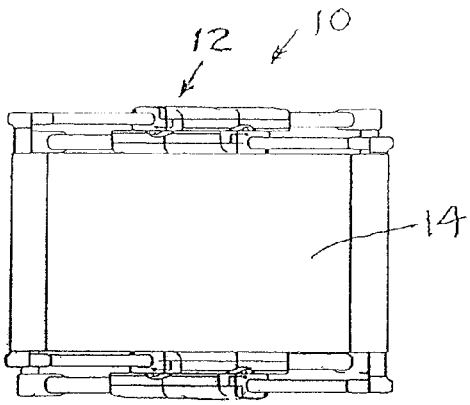
FIG. 4 is a top plan view of the stool as it appears in FIG. 3.
Figure 8:
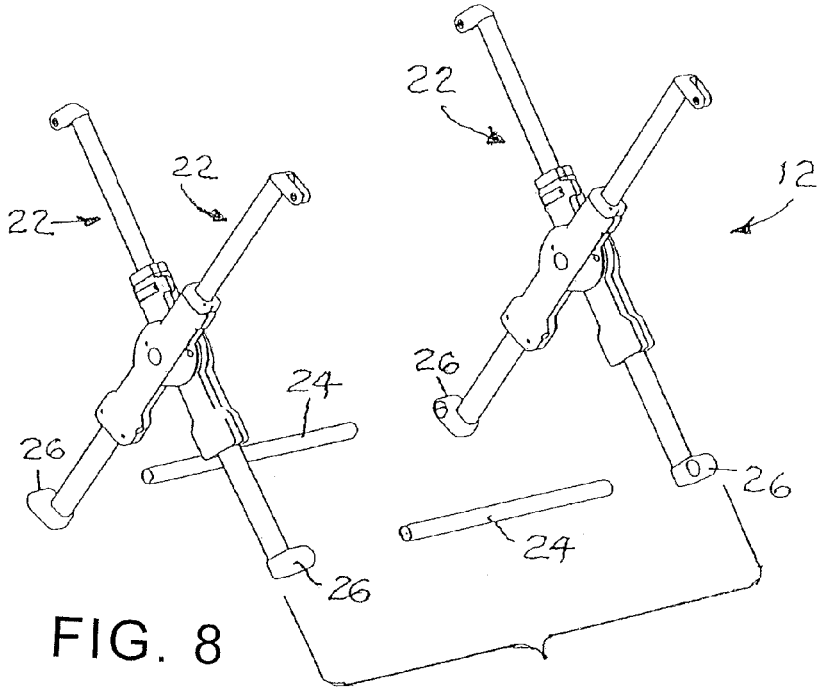
FIG. 8 is an exploded perspective view of a portion of the stool frame.
Figure 9:
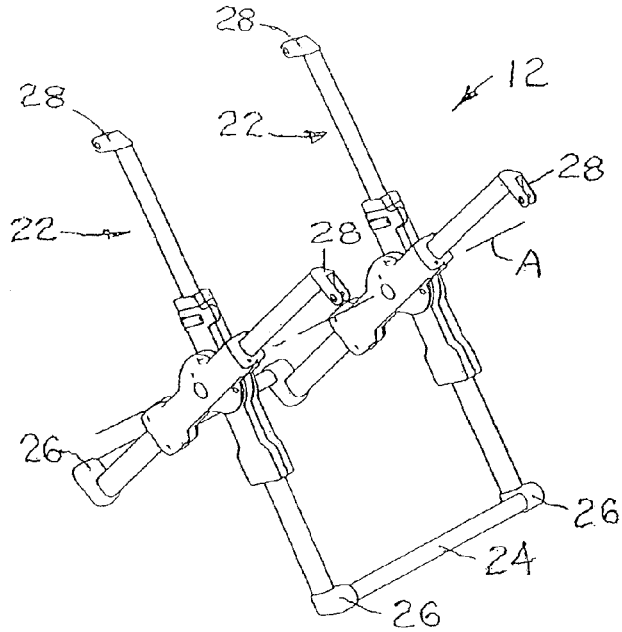
FIG. 9 is a perspective view of the frame structure of FIG. 8 shown in assembly.

Referring now to FIGS. 8 and 9 where the frame 12 is further illustrated, it should be noted that the lower ends of the retractably collapsible front and rear leg members 22, 22 are connected in fixed position to each other by rigid laterally outwardly offset tubular connecting components 24, 24 and laterally outwardly offset knuckle fittings 26, 26. Pivot fittings 28, 28 attached to the upper end of the leg members 22, 22 provide laterally outwardly offset pivotal connections for pivoted links 27, 27 connected by elongated tubular seat support members 29, 29 which carry the seat panel 14 as shown in FIGS. 1-3. The seat support elements 29, 29 also provide laterally outwardly offset connections between the upper ends of the front and rear leg members 22, 22 and cooperate with the laterally offset lower connecting components 24, 24 to maintain the front and rear support assemblies 16, 16 in spaced apart parallel relation to each other with the axes thereof in coaxial alignment with each other to form common axis A so that the front and rear leg members 22, 22 pivot in unison between open and closed positions. The laterally outwardly offset connections between the front and rear leg members 22, 22 prevent interference which would otherwise occur if direct axially in-line connections between front and rear folding legs were provided. Thus, the leg members 22, 22 are able to attain substantially parallel relationship with respect to each other when the support assemblies 16, 16 are pivoted to closed position, as shown in FIGS. 2 and 7.

Figure 10:
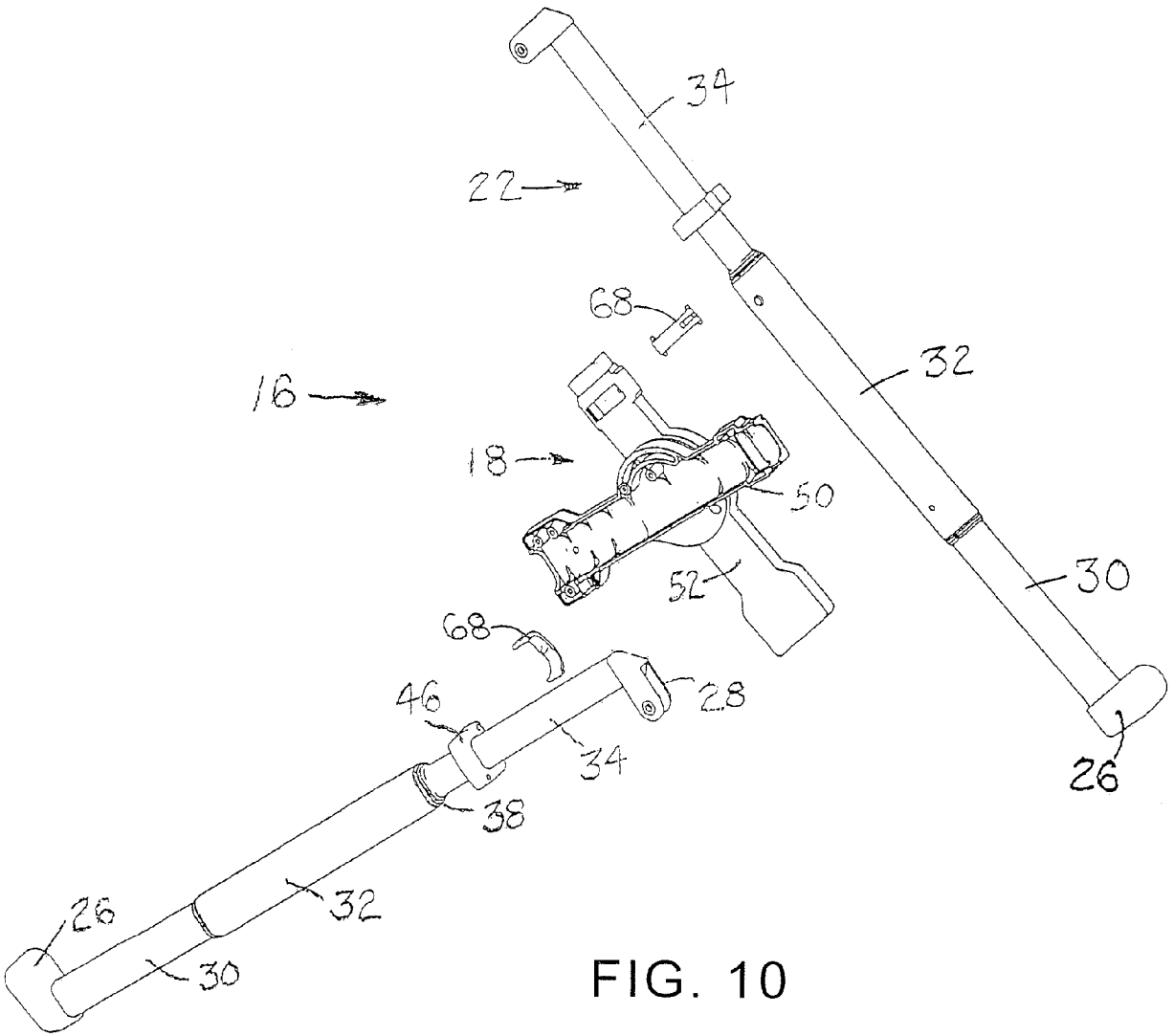
FIG. 10 is an exploded perspective view of a support assembly.
Figure 11:
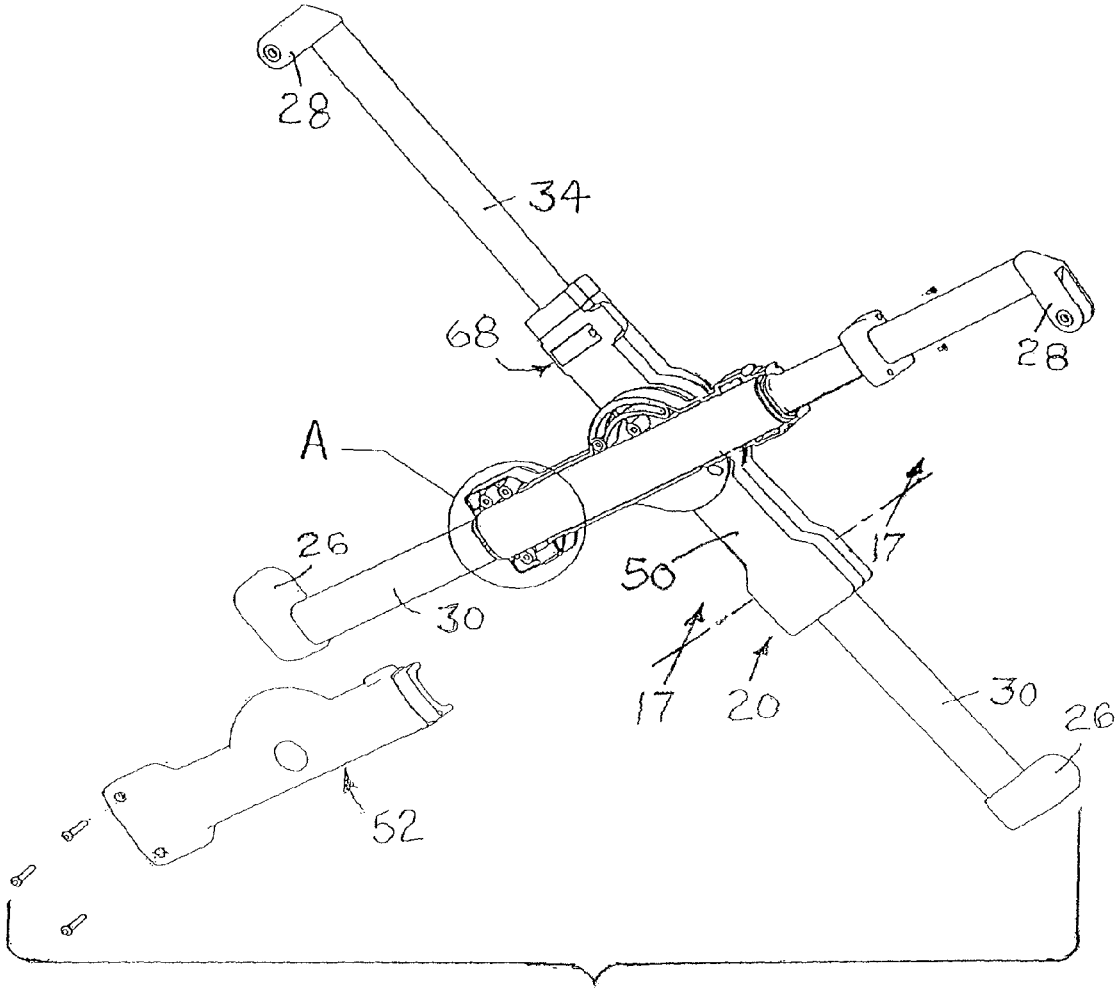
FIG. 11 is an exploded perspective view of a partially assembled support assembly.
Figure 11A:
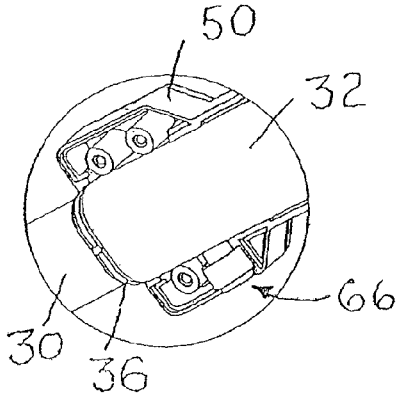
FIG. 11A is a somewhat enlarged fragmentary perspective view of a portion of the support assembly shown in FIG. 11.

A complete understanding of the construction and operation of a support assembly 16 is essential to a proper understanding of the present invention. A support assembly will now be considered in somewhat further detail. Referring now to FIGS. 10 and 11 exploded perspective views of a typical support assembly 16 is shown. The leg members 22, 22 are preferably fabricated from aluminum tubing of non-circular cross section, flat sided oval tubing (sometimes referred to as "floval" tubing) being presently preferred. In accordance with presently preferred construction, each leg member 22 is formed by at least two telescopically connected tubular leg sections. However, the leg members 22, 22 presently preferred for practicing the invention have three such leg sections of generally complementary cross-section and differing cross sectional size for telescopic assembly. More specifically, the present leg members include a lower support or leg section 30, a middle support or leg section 32 of somewhat larger cross section and an upper support or leg section 34, the smallest of the three sections, which is sized to be telescopically received within the lower leg section 30. The middle leg section 32 is received and mounted in fixed position within an associated pivot housing 20, substantially as shown in FIG. 11.

Figure 12:
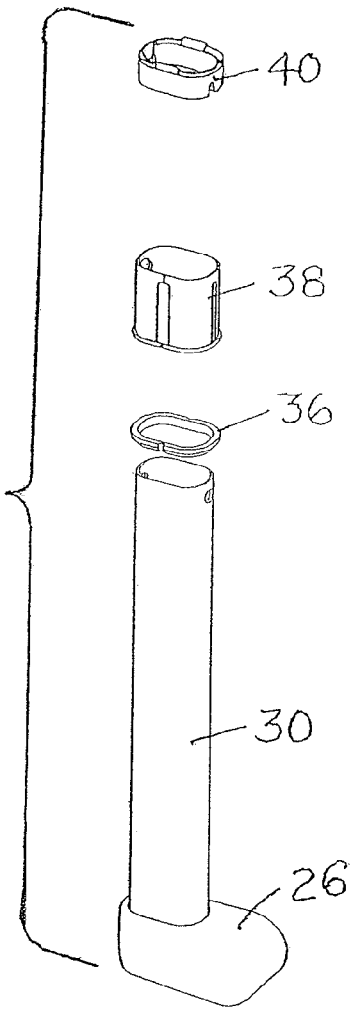
FIG. 12 is a somewhat enlarged exploded perspective view of a lower leg section assembly.
Figure 13:
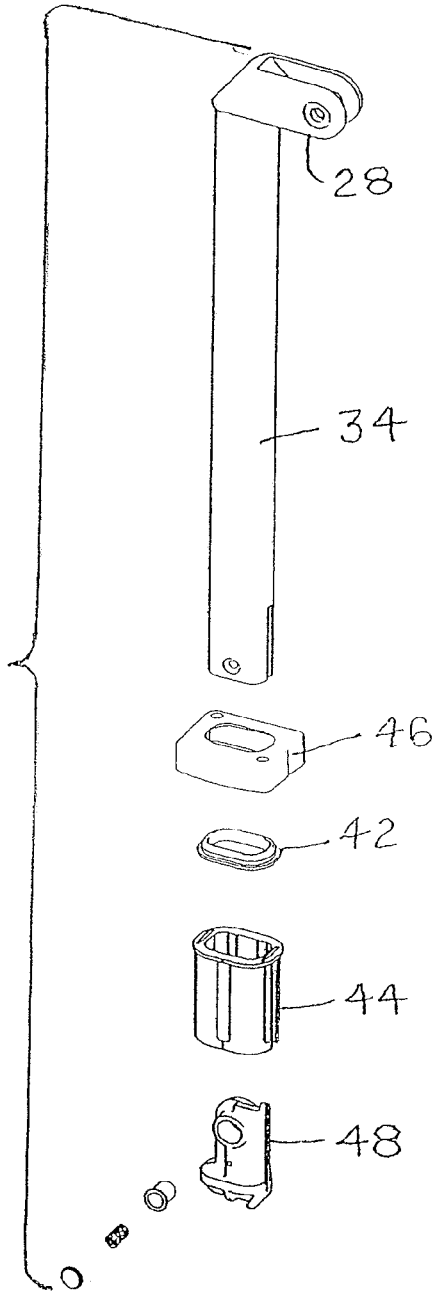
FIG. 13 is a somewhat enlarged exploded perspective view of an upper leg section assembly.

Prior to final assembly the lower section 30 comprises part of a lower leg section assembly shown in FIG. 12 and adapted to be received in the lower end of the middle leg section 32. The lower leg section assembly includes a lower seal 36, a bushing 38 adapted to be secured in fixed position within the lower end portion of the middle leg section 32, and a stop 40 mounted on the upper end of the tube section 30. The upper leg section 34, (FIG. 13) is part an upper leg section assembly which includes an upper seal 42, an upper bushing 44, and a pivot housing cap 46. The upper seal 42 and the upper bushing 44 are adapted to be secured in fixed position within an associated pivot housing. The cap 46 comprises a part of the latter housing. A cam plunger 48 is mounted on the lower end of the upper leg section 34 for a purpose which will be hereinafter evident. Withdrawal of the upper leg section 34 from the middle section 32 is prevented by the bushing 44. Each upper leg section 34 also has a laterally outwardly offset pivot fitting 28 at its upper end, as previously discussed.

Figure 14:
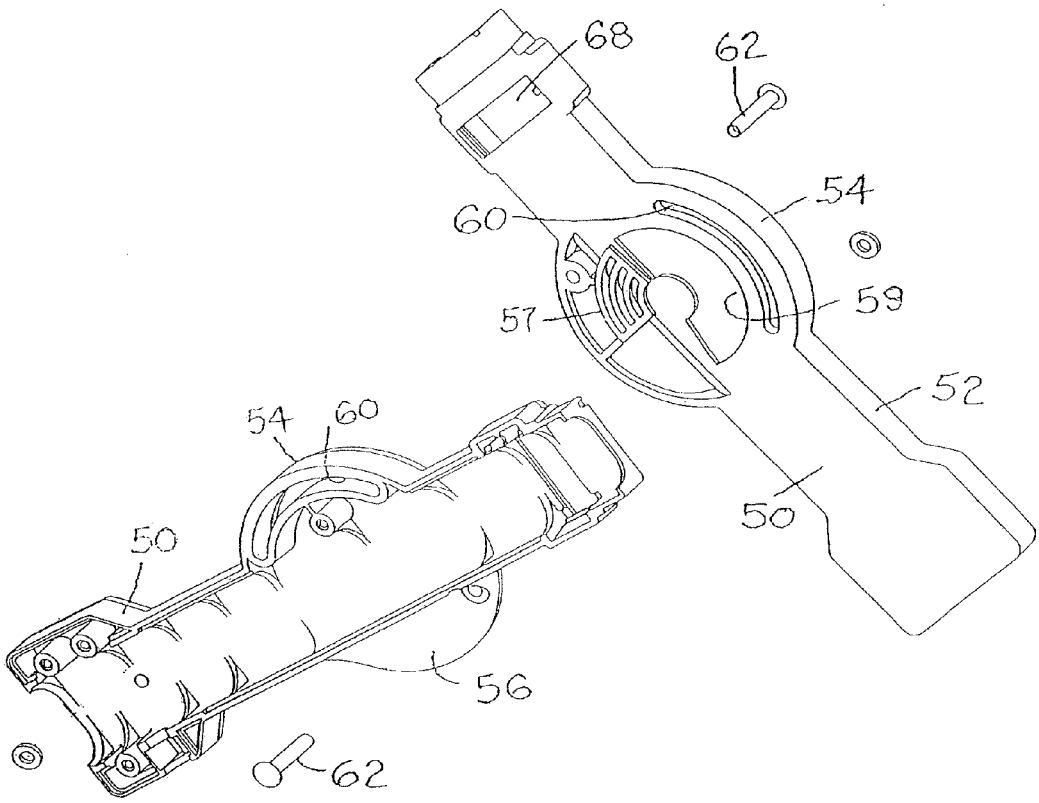
FIG. 14 is a somewhat enlarged exploded perspective view of a pair of coupled pivot housing bases.
Figure 15:
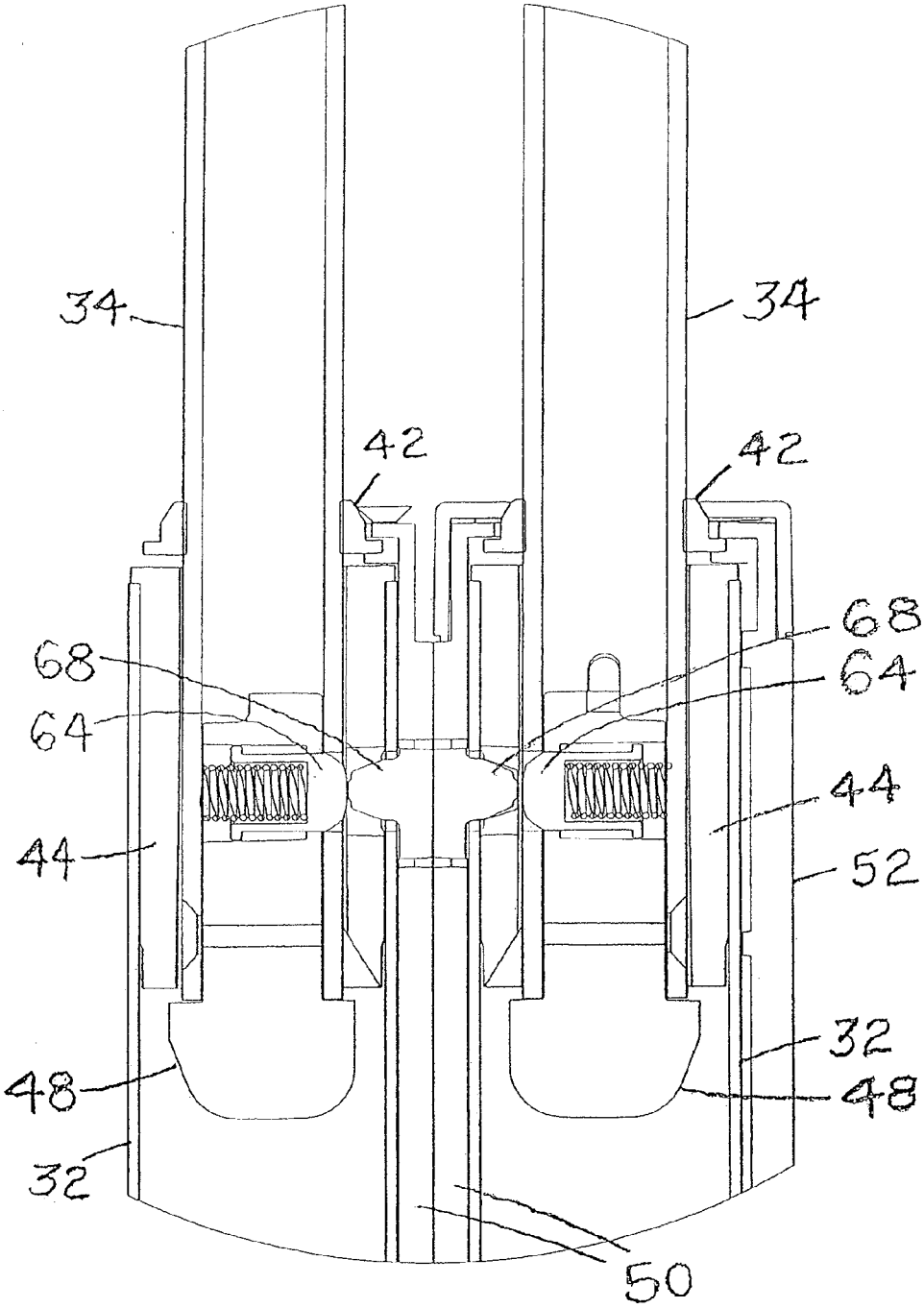
FIG. 15 is a somewhat further enlarged fragmentary sectional view taken along the line 15-15 of FIG. 21.

Each of the two pivot assemblies 18, 18 which support an associated pair of leg members 22, 22 for pivotal movement comprises a pair of pivot housings 20, 20 as shown in FIG. 14. Each hollow pivot housing 20 includes a housing base 50, a housing cover 52, secured to the housing base by threaded fasteners, and a housing cap 46. Prior to assembly with the housing, the cap forms a part of an associated upper leg section assembly, as previously discussed.

All of the parts of each pivot housing 20 as well as each of the various leg member fittings are preferably molded from a durable plastic material, Durethan B 30 S Nylon being presently preferred. The upper and lower end seals 42 and 36 are preferably formed from a somewhat softer and more resilient plastic material, polyethyene being the present choice.

Each pivot housing base 50 has a pair of integral centrally located cheeks 54 and 56 which project from its opposite sides to define portions of a central hub. The two housings 20, 20 which comprise a pivot or hub assembly are assembled with the central or hub portions thereof in face-to-face relation to each other. The cheek 54 of each housing base has an arcuate slot 60 extending through it in an axial direction and having a center of curvature located on the common axis A. The pivot housings 20, 20 are assembled with the central hub portion surfaces thereof in frictional engagement and are secured in assembly by two rivets 62, 62. Each rivet is mounted in fixed position on a cheek 56 of one of the housings and passes through an arcuate slot 60 formed in the cheek 54 of the other of the housings. The rivets and slots cooperate to define the unintruding virtual axis of rotation A which comprises a means for enabling the two pivot housings 20, 20 to pivot relative to each other and may also serve as means for limiting angular movement of the pivot housings. Each housing base 50 carries a raised arcuate boss 57 on its inwardly facing exterior surface and has an arcuate recess 59 which opens through that surface as best shown in FIG. 14. The boss 57 on each pivot housing base 50 is disposed within the arcuate recess of the other housing base 50 when the two housing bases are joined in face-to-face relation for angular movement relative to each other. The bosses 57, 57 cooperate with the recesses 59, 59 to provide means for limiting angular movement or arcuate travel of the bases relative to each other. Thus, the two pivot housings are connected to each other for limited angular movement by the rivets 62, 62 which are located outboard of channels formed in the housing bases 50, 50 and covers 52, 52 which cooperate to retain the middle leg sections 32, 32 of the pivot housings. Each movable leg section is free to move outwardly relative to its associated pivot housing and to an extended position wherein it projects from and a substantial distance beyond its associated pivot housing. In like manner, each movable leg section is free to move into its associated pivot housing to a retracted position wherein it extends transversely through and beyond the common axis A.

Figure 16:
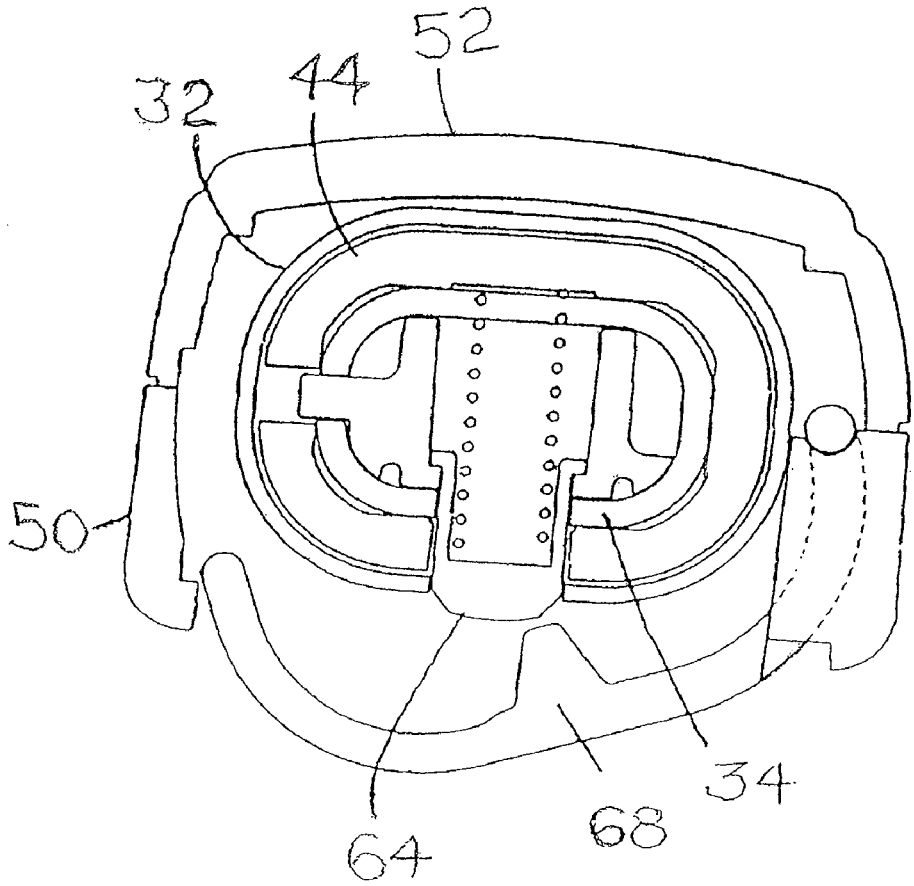
FIG. 16 is a somewhat enlarged sectional view through an upper end portion of a pivot taken generally along the line 16-16 of FIG. 3.
Figure 17:
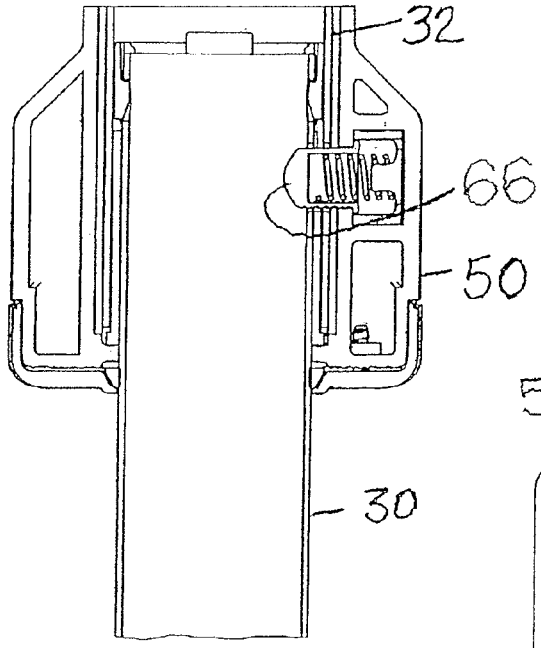
FIG. 17 is a somewhat enlarged fragmentary sectional view through a lower end portion of a pivot housing taken along the line 17-17 of FIG. 11.
Figure 18:
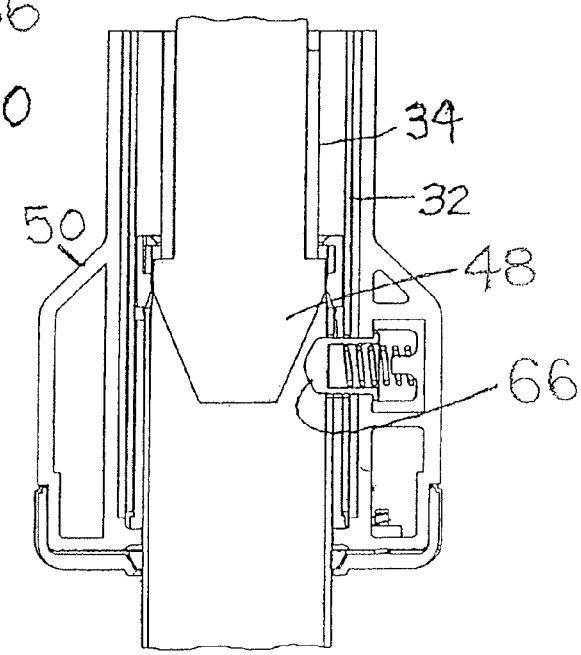
FIGS. 18 and 19 are similar to FIG. 17 but shows successive positions of release of a lower leg section retaining button.
Figure 19:
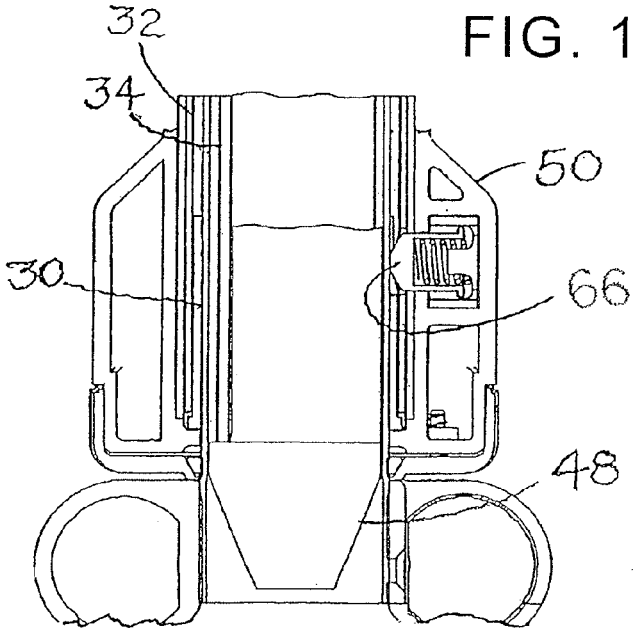

Further, and in accordance with the present invention, means for retaining each of the four telescopically extendable and retractable support or leg sections in extended position are provided. Each extendable upper leg section 34 carries a first spring biased detent button 64 which has a cylindrical body portion terminated by a parti-spherical free end portion. The button is biased outwardly through an aperture in the wall of the upper leg section 34. A cylindrical portion of the projected button 64 is received within an associated generally complementary aperture in an upper end portion of the middle leg section 34 (FIG. 16). In generally like manner, means for retaining each lower leg section 30 in extended position includes a second spring biased, generally cylindrical detent button 66 mounted in the pivot housing base near the housing base lower end. The second detent button 66 is biased inwardly through a complementary aperture in the middle leg section 32 of each leg member 22 and into an aperture which opens laterally through a side wall of another associated support or lower leg section 30 near the upper end of that section. It should now be apparent that when each of the telescopically mounted movable upper and lower leg sections is withdrawn from its associated pivot housing and moved longitudinally to its extended position it will be automatically latched in the latter position by an associated one of the spring biased detent buttons 64 and 66 in response to movement to its extended position.

The present invention also contemplates provision of automatic releasing mechanism to facilitate rapid telescopic collapse of both the upper and lower leg sections to retracted positions within respectively associated pivot housings 20, 20.

In accordance with the invention, a releasing member 68 carried by each pivot housing 20 and exposed externally thereof and beyond an exterior surface of the pivot housing provides a means for releasing the first or upper detent button 64 thereof by biasing it toward its release position as the support assembly 16 approaches closed position in moving from open position to closed position. The releasing member 68 is a generally U-shaped part adapted to pivot at one end on a fulcrum formed by a wall of the pivot housing base. Each releasing member 68 is adapted to straddle a portion of an associated upper leg section 34 and has a projection or operating button 65 on its inner surface for engaging detent button 64 (FIG. 16). The releasing member 68 is biased outwardly through an aperture in the pivot housing 20 which opens through the inner surface thereof. The releasing member 68 has a ramp surface 69 (FIG. 16) extending outwardly and away from its pivoted end. As the support member approaches its fully closed position, the ramp surface on the releasing member 68 carried by each of the two pivot housings comes into engagement with the other of the pivot housings whereupon further movement of the two pivot housings toward closed position causes the ramp surfaces to simultaneously move both releasing members 68, 68 toward releasing position to bias both detent buttons 64, 64 toward and to released position. Full release of the first detent occurs when each leg assembly 22 is about twenty degrees away from fully closed positions, that is the position in which the leg assemblies are in generally parallel relation to each other. At this point, light downward pressure applied to the base member 12 with the lower legs resting on a support or reaction surface will result in full retraction of the upper leg sections 34, 34 into respectively associated pivot housings.

After the lower ends of the upper leg sections 34, 34 pass through and beyond the axis A, the lower ends of the upper leg sections enter the somewhat larger lower leg sections 30, 30 causing the cam plungers 48, 48 on the lower ends thereof to engage the second detent buttons 66, 66 biasing these buttons outwardly and to positions wherein the free ends of the second or lower detent buttons are substantially aligned with the inner surfaces of the lower leg sections 30, 30. Further light downward pressure applied to the now partially collapsed frame 12 will cause the wall around the aperture in each lower leg section to exert camming action upon an associated crowned free end portions of a second detent button causing these buttons to be biased outwardly and out of engagement with the lower leg sections so that these sections are released and are free to telescope upwardly within the middle leg sections 32, 32 while, at the same time, receiving the upper leg sections therein. The lower leg sections will move upwardly within the middle leg sections through and beyond the common axis A to fully retracted positions within the pivot housings.

Figure 20:
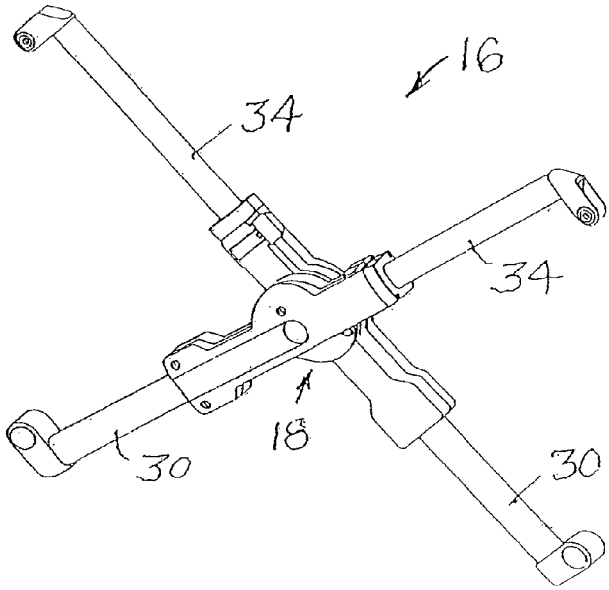
FIG. 20 is a perspective view of a support assembly shown in open position with the upper and lower leg sections extended.
Figure 21:
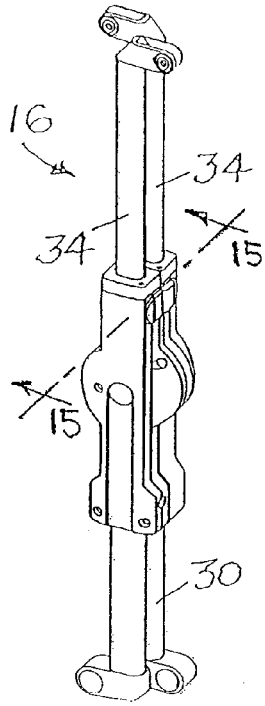
FIG. 21 is a perspective view of the support assembly of FIG. 20 shown in closed position with the upper and lower leg sections extended.
Figure 22:
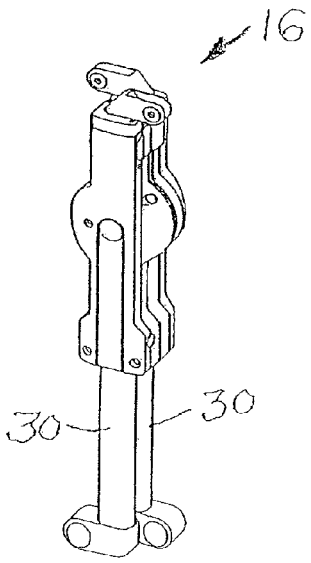
FIG. 22 is a perspective view of the support assembly of FIG. 20 shown in closed position with the lower leg sections extended and the upper leg sections retracted.
Figure 23:
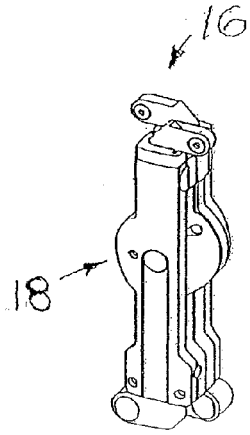
FIG. 23 is a perspective view of the support assembly of FIG. 20 shown in collapsed condition.

FIGS. 20 through 23 illustrate successive steps performed in collapsing a typical support assembly 16 from open or setup position to closed or collapsed condition. FIG. 20 shows the support assembly 16 in open position, that is a position corresponding to the position of the support members on the base of stool 10 when the stool is in its set up condition. In the open position, the crossed leg assemblies present a generally x-shaped configuration. FIG. 20 shows the support assembly after the leg members 22, 22 have been pivoted to closed position, that is a position wherein the leg assemblies are disposed in substantially parallel or near parallel relation to each other. In the latter position, the first detent buttons 64, 64 have already been moved to released position by the release members 68, 68 which are now in face-to-face relation to each other in releasing position. Light downward pressure applied at the upper ends of the upper leg sections 34, 34 while the lower ends of the lower leg sections are resting on a support or reaction surface causes the upper legs to move downward and into the pivot assembly and to a fully retracted position as shown in FIG. 22. When the upper leg sections 34, 34 attain fully retracted position, the cam plungers 48, 48 at the lower ends of the upper leg sections will have engaged the lower or second detent buttons 66, 66 and moved these buttons to respectively associated release positions so that the continued application of the downwardly directed force will produce smooth transition from the fully retracted upper leg sections to the released and fully extended lower leg sections, causing the pivot housings and the upper leg sections to move downwardly, thereby moving the pivot assembly downwardly to a position wherein the lower leg assemblies are fully retracted into the pivot housings as shown in FIG. 23.

Returning now to consideration of the stool 10 and its frame 12 shown in FIGS. 1-7, it should be noted that during initial movement of the base assembly from its opened to its fully closed position the upper ends of the leg members 22, 22 may engage the connected outer ends of the seat panel 14 which are free to pivot laterally outward and out of the path of the leg member upper ends. The horizontal connecting components 24, 24 which provide connection between the lower ends of the lower leg sections 30, 30, being laterally outwardly offset from the lower ends of the lower leg sections, allow the lower leg sections to attain fully closed position. Both the upper and the lower leg sections which comprise each support member may freely attain the fully closed position after which the upper and lower support members or legs may be moved to the fully retracted position of FIG. 6 by the simple application of a downwardly directed light force in opposition to the resistance of the floor or other stool supporting surface. Thus, the stool 10 may be rapidly collapsed by merely pivoting the leg members to closed or nearly closed position and applying downwardly directed force to the upper portion of the stool in opposition to the resistance of its supporting surface. During the closing motion of the stool, the flexible seat panel 14 may be guided to a depending position between the upper leg sections as the latter sections move into closed position. In the latter position of the stool, its front elevational profile (FIG. 7) and its side elevational perimeter (FIG. 6) are of substantially minimal dimension.

Figure 24:
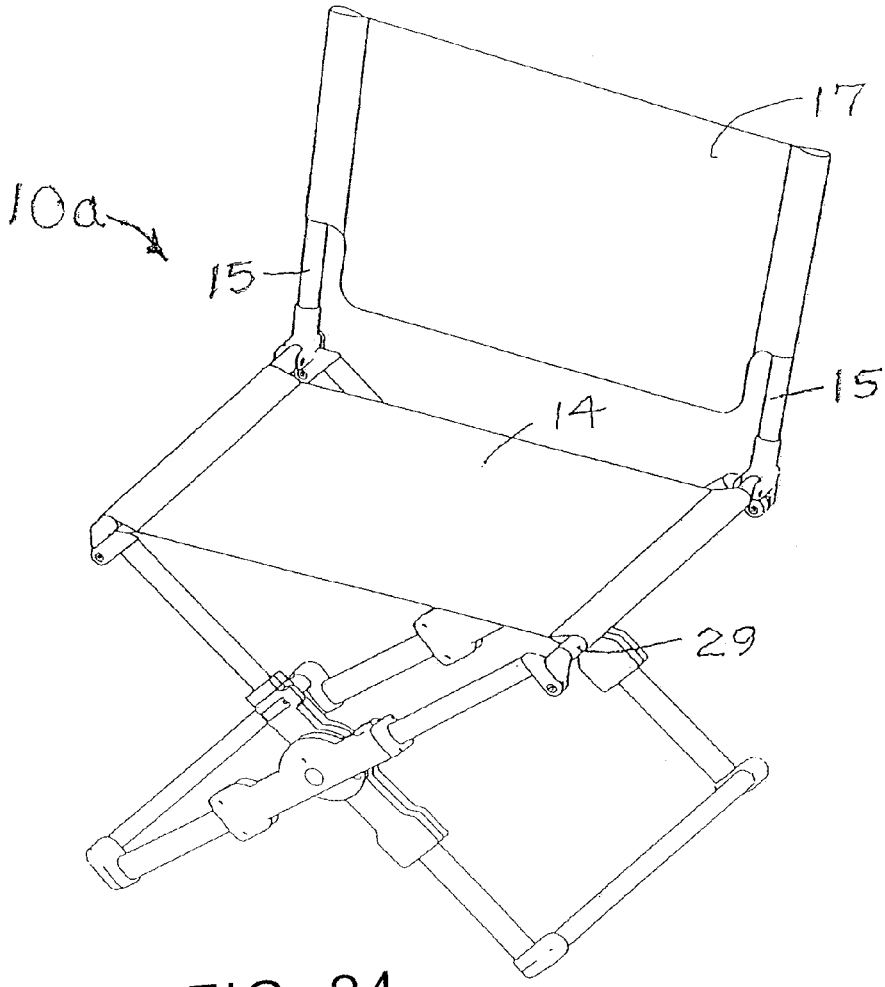
FIG. 24 is a perspective view of a side chair of outdoor type embodying the present invention.
Figure 25:
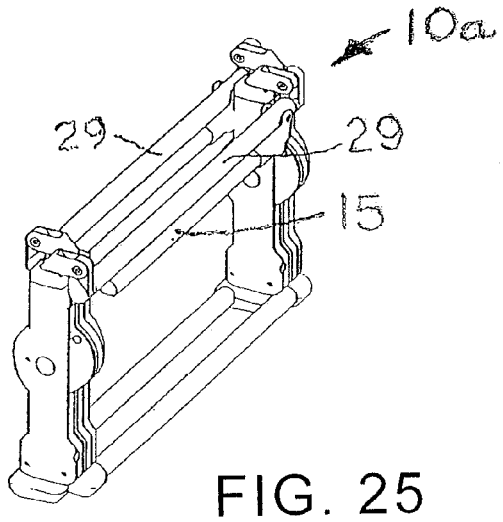
FIG. 25 is a perspective view and shows the frame of the chair of FIG. 24 in collapsed condition.

The frame 12 hereinbefore illustrated and described with reference to the stool 10 may be employed as a whole or in part in the production of other articles of furniture embodying the invention, such as the lounge chair shown in FIG. 24. The lounge chair, designated generally at 10*a*, essentially comprises the stool 10 with added collapsible or fold down back support members 15, 15. Each back support member is pivotally connected to an associated one of the horizontally disposed seat panel support elements 29 by a pivot fitting which maintains the back support member in an upwardly and rearwardly inclined position relative to the seat panel. A flexible back panel 17 slips down over the free upper ends of the upwardly extending back support members. When the back panel has been removed by slipping it off of the back support members the extended leg assemblies may be folded from open to closed positions. The pivoted links which carry the seat supports 29, 29 are free to pivot downwardly and laterally outwardly to depending positions below the pivot fittings to which they are secured, whereby the links position the seat support elements with the seat back members folded to collapsed position adjacent thereto below the pivot fittings to which the connecting links are attached. Thus, both the seat support members and the seat back supports 15, 15 may pivot to positions of non-interference with respect to the upper ends of the leg assemblies of each support member when the chair base 12 is pivoted or folded from its open to its closed position.

Figure 26:
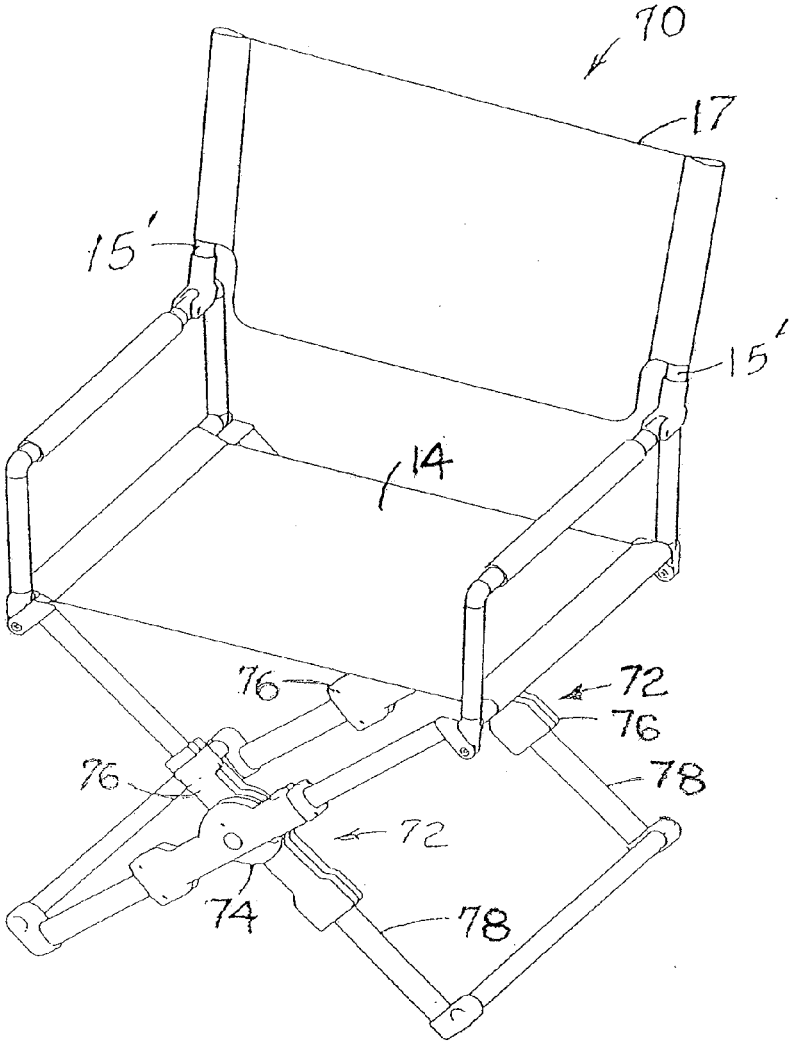
FIG. 26 is a perspective view of an arm chair of outdoor type embodying the present invention.
Figure 27:
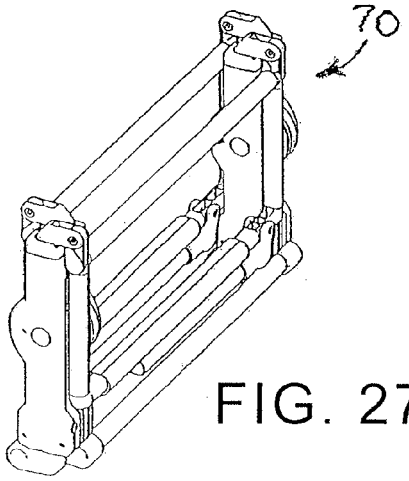
FIG. 27 is a perspective view and shows the frame of the arm chair in collapsed condition.
Figure 28:
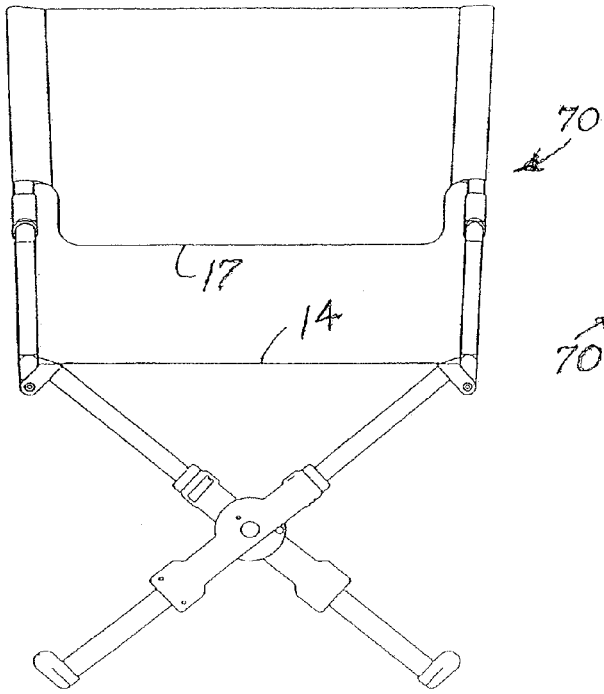
FIG. 28 is a front elevational view of the arm chair of FIG. 26.
Figure 29:
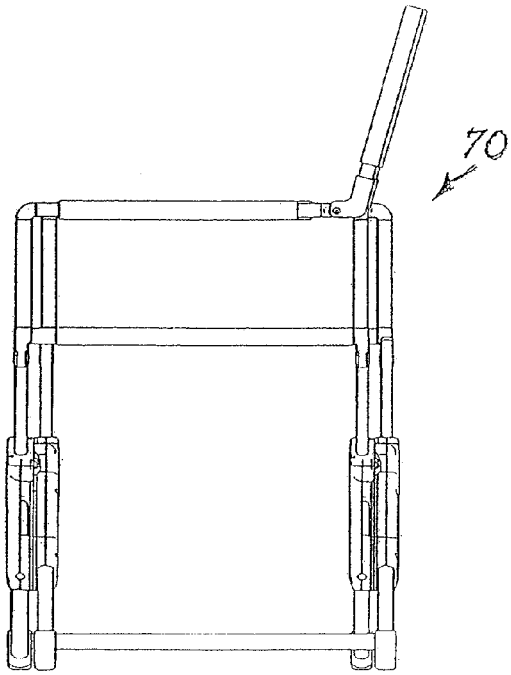
FIG. 29 is a side elevational view of the arm chair.

Further referring to the drawings and particularly FIGS. 26-43, a collapsible portable arm chair designated generally by the numeral 70 is shown in set-up condition ready for use in FIGS. 26, 28 and 29. The chair 70 illustrates a full-size chair adapted to accommodate an adult in normal sitting position. In collapsed or portable condition, as it appears in FIGS. 27, 30 and 31, the arm chair 70 is about the size of an average laptop computer and can easily be carried in a soft collapsible carrying bag having a shoulder strap and/or a handle. A carrying handle or strap sewn to the rear surface of the chair back panel facilitates carrying the collapsed chair without a carrying container, as will be hereinafter further noted.

In the further description which follows, parts of the chair 70 substantially identical to parts previously described, bear the same reference numerals as the previously described parts and will not be discussed in further detail.

The armchair 70, as shown in FIGS. 26-31 has a pair of inverted U-shaped arms 71, 71, the lower ends of which are directly pivoted on pivot fittings carried by the upper ends of the leg assemblies. Seat back support members 15', 15' are carried by the arms 71, 71 substantially as shown in FIG. 26. The seat back support members are pivotally mounted on and at the rear ends of the horizontal portions of the arms for folding forwardly and downwardly against these horizontal portions when the chair is being collapsed. The arms with the back supports 15', 15' attached thereto are pivoted laterally outwardly and downwardly against opposite sides of the chair base after the leg assemblies have been folded into parallel relation to each other in the closed position. The armchair 70 is shown with its frame in fully collapsed condition in FIGS. 27, 30 and 31.

Like the stool 10, the arm chair 70 has a collapsible supporting structure which includes front and rear support assemblies indicated generally at 72, 72. Each support assembly 72 has a centrally located pivot or hub assembly 74 formed by a pair of identical hollow pivot housings 76, 76. The pivot housings are axially coupled to each other for limited angular movement relative to each other about a common axis of rotation A, that is an axis which is common to both support assemblies 72, 72. Each support assembly 72 also includes a pair of leg members 78, 78, hereinafter further discussed.

Figure 32:
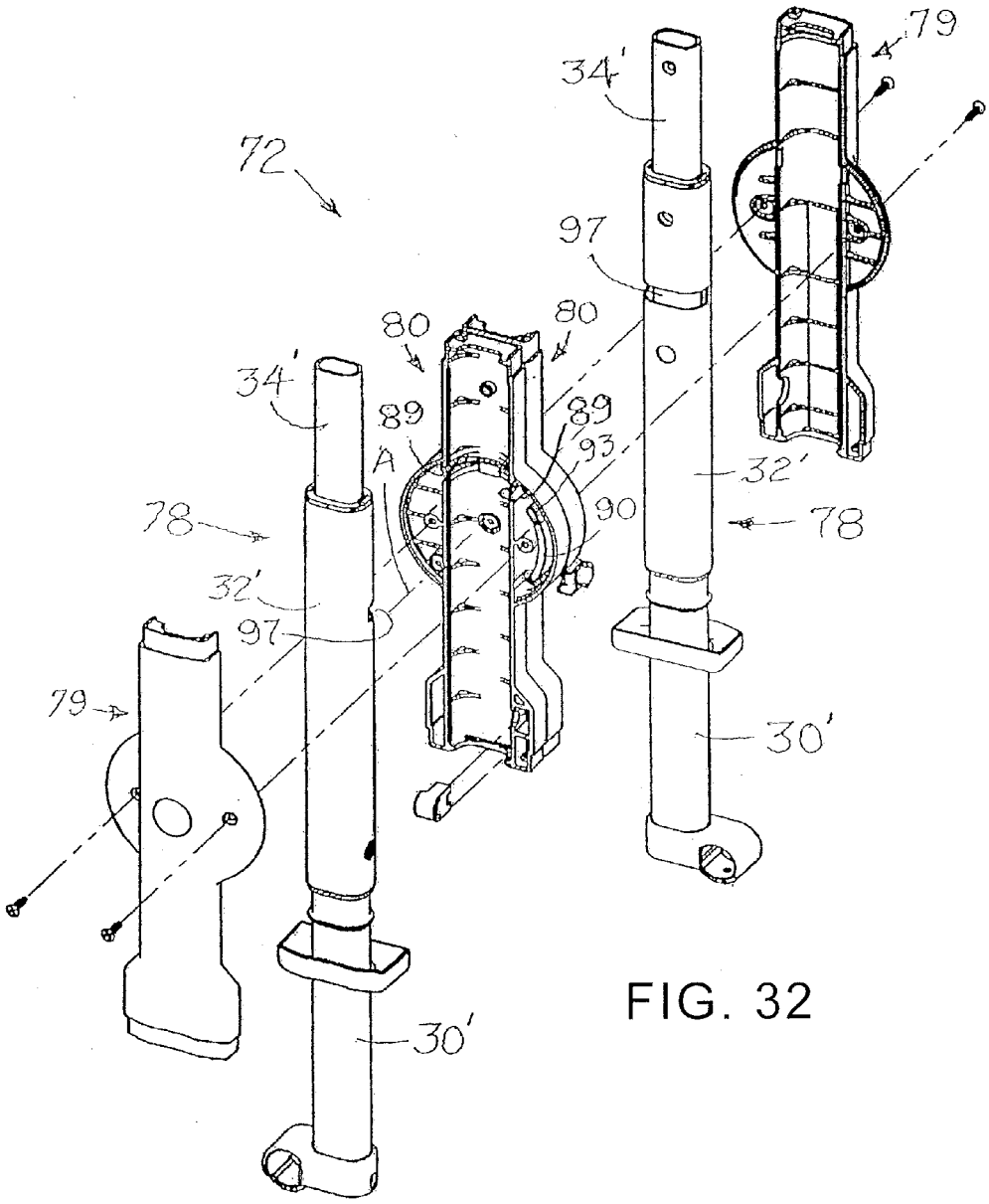
FIG. 32 is an exploded perspective view of a support assembly of the arm chair.

Considering now the pivot housings 76, 76 in further detail and the manner in which the pivot housings of each pair are axially coupled to each other and cooperate with the leg members of each associated pair, reference is made to FIGS. 32-36. Each pivot housing has a molded base 80 and cover 79, as shown in FIG. 32.

Figure 33:
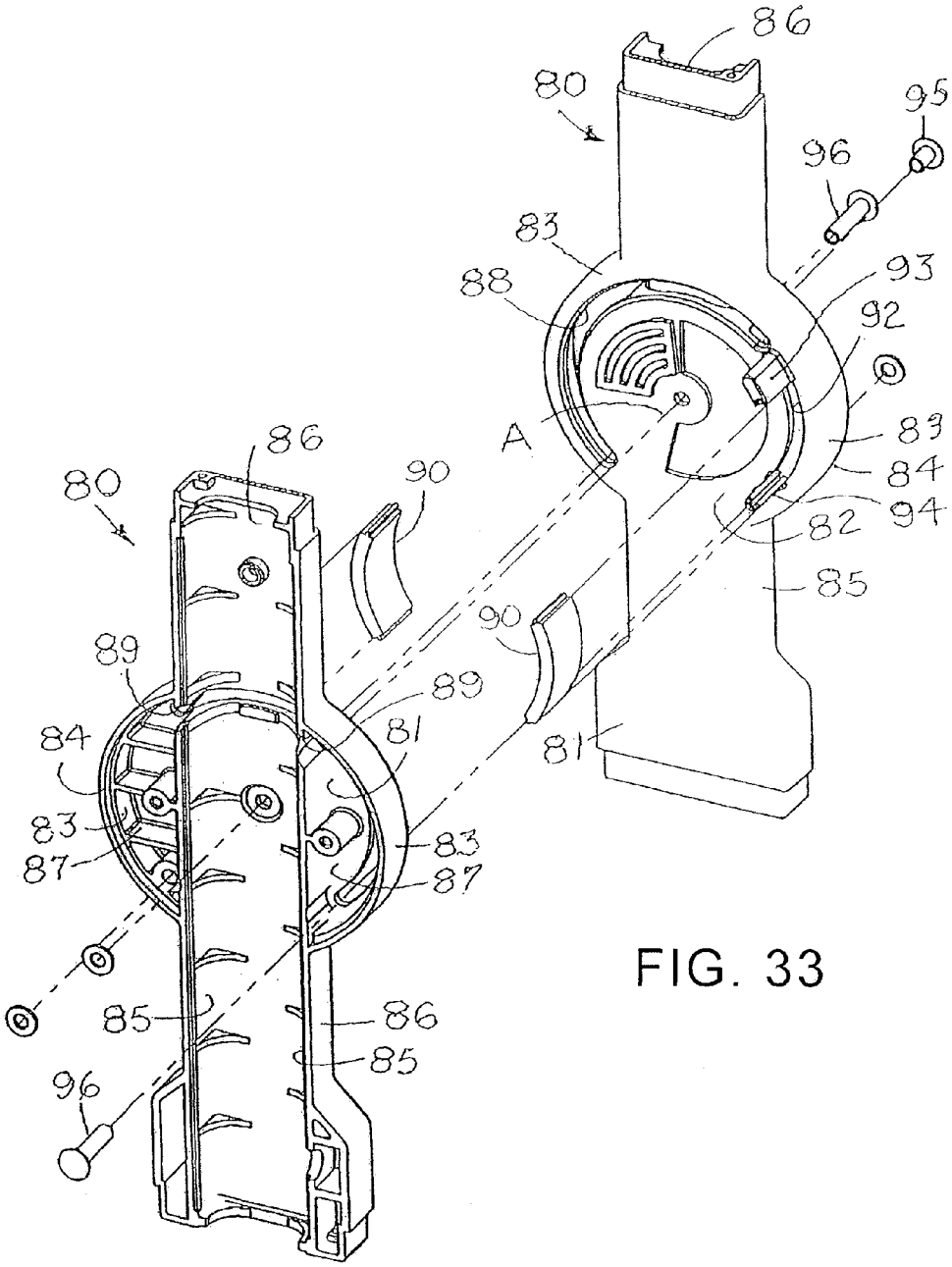
FIG. 33 is a somewhat enlarged exploded perspective view of a pivot housing base assembly of the arm chair of FIG. 26.
Figure 34:
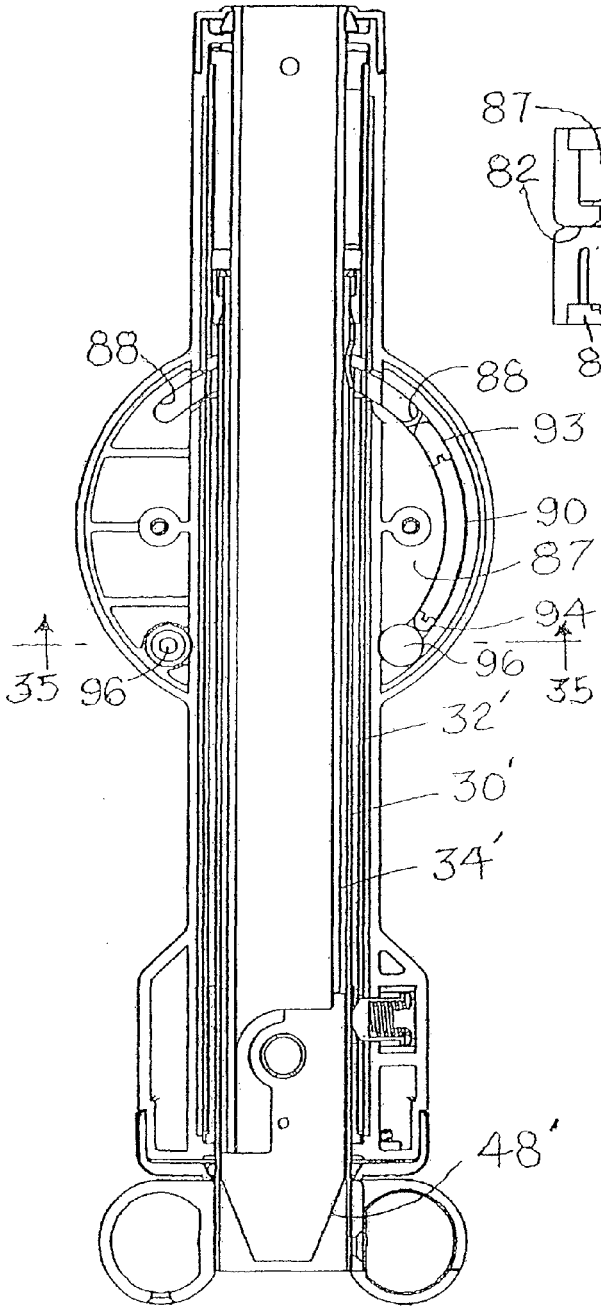
FIG. 34 is a somewhat enlarged front elevational view of the support assembly of FIG. 33 shown with the cover removed from the visable front pivot housings and showing the leg member in longitudinal axial section and in collapsed condition.
Figure 35:
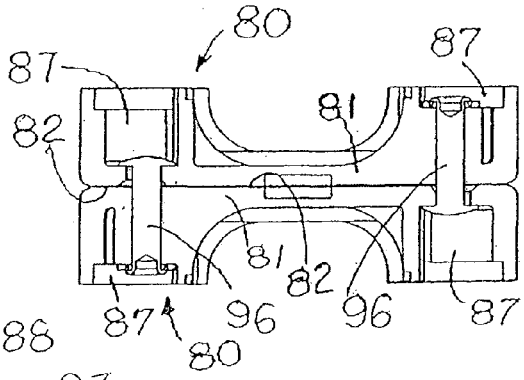
FIG. 35 is a somewhat further enlarged sectional view of a pivot housing base assembly taken along the line 35, 35 of FIG. 34 and showing only the bases of the pivot housings.

The housing base 80, best shown in FIGS. 33-35 is a unitary structure and may be described with reference to its central axis of rotation A as having an axially normal inner end wall 81 including a substantially planar axially normal exterior surface 82 and further including axially disposed side walls. The sidewalls include opposing arcuate sidewalls members 83, 83 which cooperate with the inner end wall 81 to define a generally cylindrical cup-shaped outwardly open central hub portion 84 and opposing longitudinally elongated sidewall members 85, 85 which cooperate with the inner end wall 81 and transcend the central hub portion 84 to define an elongated longitudinally extending outwardly open channel member 86 which intersects and extends diametrically through and beyond the central hub portion 84 in both directions of channel extent. Portions of the channel defining sidewalls 85, 85 located within the central hub portion 84 cooperate with the arcuate sidewall members to define hollow cheeks 87, 87 within the central hub portion of the housing base and at opposite sides of the channel member 86.

Referring now to FIG. 33, each of the identical pivot housing bases 80, 80 has an arcuate slot 88 through its inner end wall 81 and centered on the base axis A as best shown with reference to the housing base 80 which is remote from the viewer in the exploded perspective view of FIG. 33. When the base 80 is positioned as shown with the longitudinal axis of the channel member 86 vertically oriented, the slot 88 extends in counterclockwise direction preferably from about the two o'clock position to about the seven o'clock position. Outwardly open slots 89, 89, somewhat wider than the slot 88 open outward through the sidewall members 85, 85 and communicate with the slot 88, for a purpose which will be hereinafter apparent.

Each housing base 80 carries an arcuate shut-off element or fence 90 which is centered on the pivot axis of its associated housing base 80 in alignment with the base slot 88. The presently preferred fence comprises a metal insert, preferably aluminum, and is partially supported within an inwardly open blind slot 92 formed in the inner end wall 81 and further supported at its opposite ends by end support members 93 and 94 integrally connected to the housing base and best shown in FIGS. 33 and 34. The fence 90 and its end support members 93 and 94 extend in clockwise direction from about the two o'clock position to about the four o'clock position. In the further description which follows and in the claims where the interchangeable terms shut-off element 90 or fence 90 is employed, each of these terms is to be construed as collectively including the insert 91 and the end support members 93 and 94 which support the insert on an associated housing base 80.

Each pair of pivot housing bases 80, 80 which comprise a support assembly are centrally coupled with the respective exterior surfaces 82, 82 thereof in face-to-face relation as illustrated in FIGS. 33 and 35. Central coupling is provided by a rivet 95 which serves as a pivot pin. The head of the rivet 95 is received within an outwardly open counter bore in the inner end wall of one of the housing bases whereas the upset end of the rivet is received within an identical counter bore in the other housing base. As will be hereinafter evident, the countersunk pivot pin 95 provides means for enabling angular movement about and unintruding axis of support for the housing bases 80, 80. When the two housing bases 80, 80 are coupled for angular movement relative to each other, the shut-off element or fence 90 on each of the housing bases extends through the slot 88 in the other of the members and into the other of the members as shown in FIG. 32.

The housing bases 80, 80 are further connected to each other by a pair of rivets 96, 96 best shown in FIG. 33. The rivet 96 remote from the viewer passes through the slot 88 formed in the pivot housing 80 remote from the viewer and is anchored in a boss 98 located within the left cheek 87 of the housing base 80 shown in the foreground of FIG. 33. In like manner, the rivet 96 shown in the foreground of FIG. 33 passes through the slot 88 in the near housing 80 at about the seven o'clock position and is anchored to a boss carried by the remote pivot housing base 80 and located within the right cheek of the housing, but not shown. The rivets 96, 96 add strength and stability to the structure and travel freely within the slots 88, 88 when the support assembly is moved between open and closed positions.

Referring again to FIG. 32, the illustrated leg members 78, 78 are substantially identical in many respects to the leg members 22, 22 shown in FIG. 10 and hereinbefore described with reference to the stool 10. A typical leg member 78 differs from a corresponding leg member 22 in that its upper leg section, indicted at 34' in FIG. 32 does not include an upper detent button 66. The middle leg section of the leg member 78, indicated at 32' has an inwardly open slot 97 opening through the inner half of the leg and which is somewhat wider than the slots 88, 88 formed in the pivot housing bases 80, 80. Each leg member 78 is otherwise substantially identical to a previously described leg member 22.

Further referring to FIG. 32, the middle leg section 32' of each leg member 78 is mounted in fixed position within an associated pivot housing with the slot 97 in communication with the arcuate slot 88 and the sidewall slots 89, 89. Each leg member 78 is secured in an associated pivot housing by a housing cover 79 attached to the housing base by threaded fasteners, substantially as shown in FIG. 32.

Figure 36:
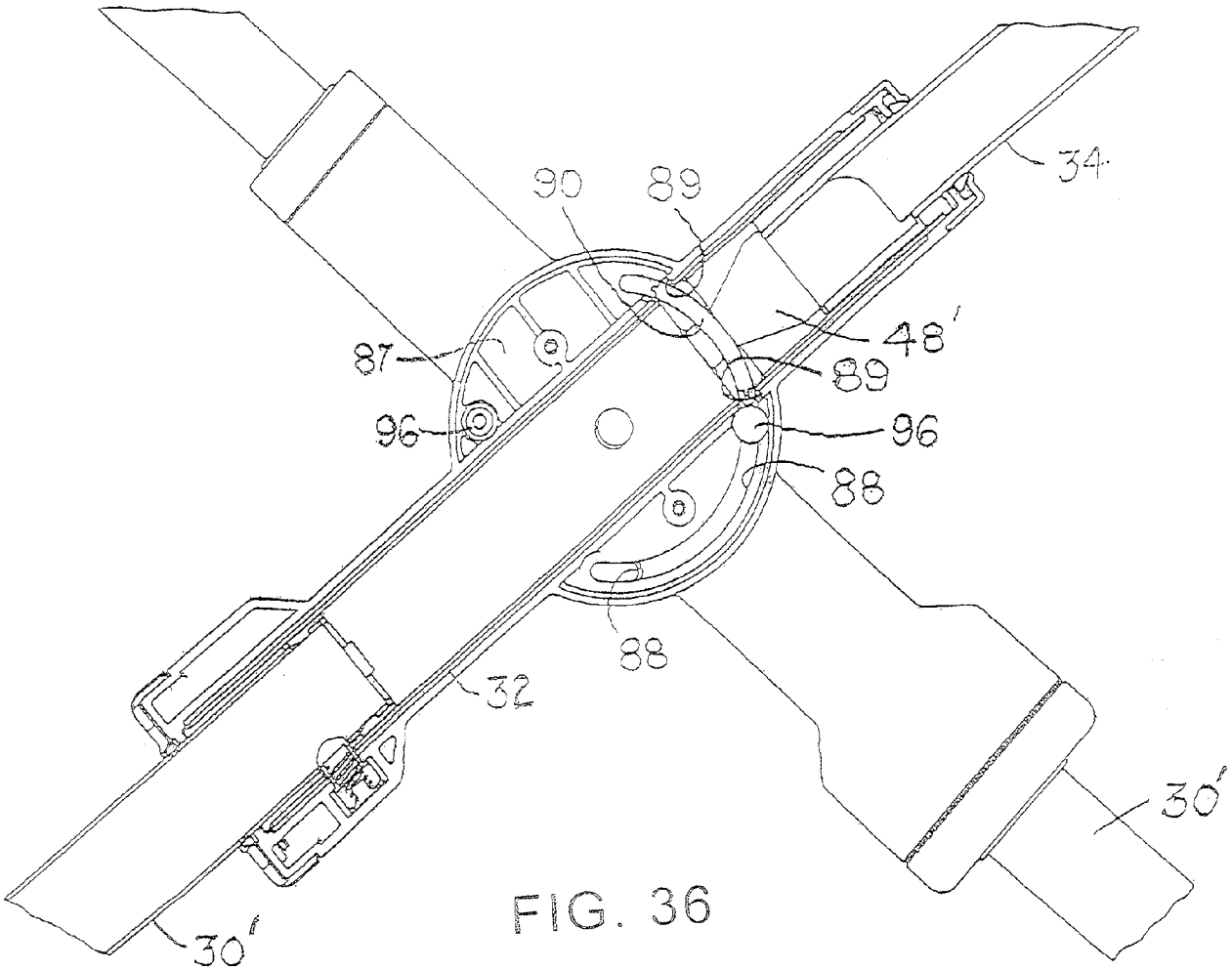
FIG. 36 is similar to FIG. 34 but shows the support member in open position with the upper and lower leg sections in extended positions.
Figure 37:
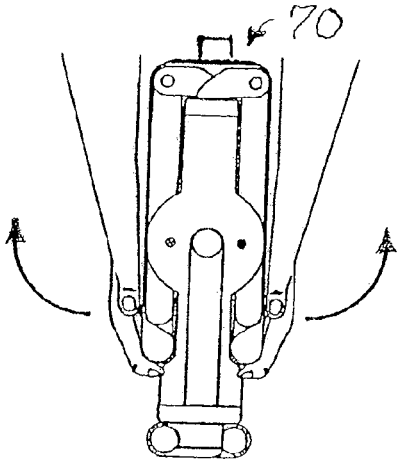
FIGS. 37-43 illustrate successive steps to be performed in setting up the arm chair.
Figure 38:
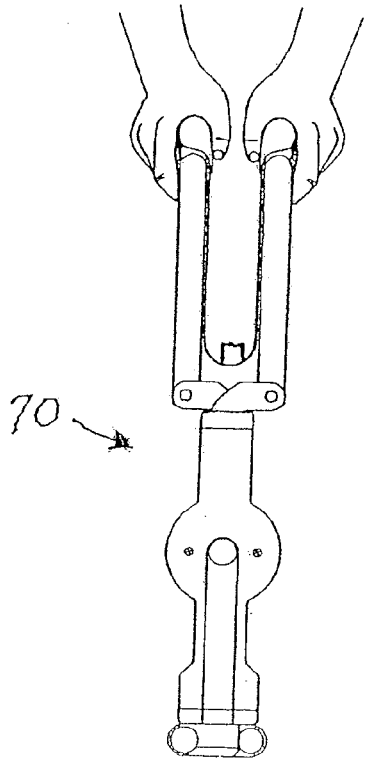
Figure 40:
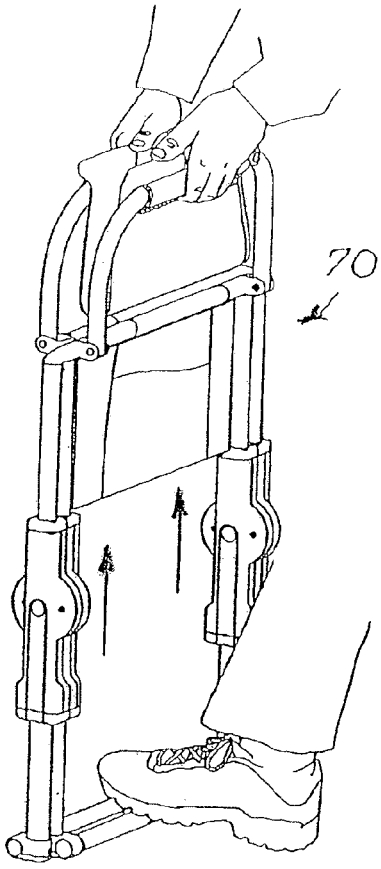
Figure 39:
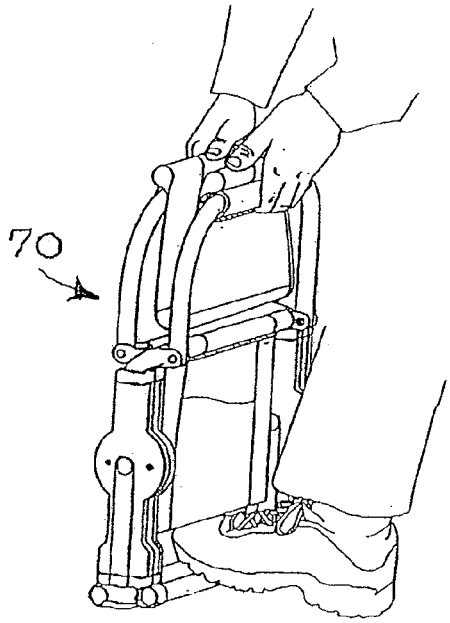

Referring now to FIGS. 34 and 36, operation of the shut-off or fence mechanism will be briefly considered. FIG. 34 illustrates a support assembly 72 which includes a pair of pivot housings 76, 76 shown with the covers removed. The support assembly 72 is shown in collapsed condition with the pivot housings in a closed position of parallel alignment with each other and the leg sections in retracted position within the pivot housings. Only a portion of the second or rearmost pivot housing being shown, that portion being the fence 90 which projects through the arcuate slot 88 and into the right cheek 87 of the frontal pivot housing base 80. The fence carried by the pivot housing in frontal position, but not shown, is mounted on its left cheek and extends through the arcuate slot which opens through the inner end wall of the pivot housing base immediately therebehind the visible base in frontal position in FIG. 34.

When the various leg sections are in retracted position, the leg sections effectively block the slots 89, 89 defined by the channel member sidewalls and lie in the paths of the leading ends of the two fences 90, 90 which comprise the shut-off mechanism for the support assembly 72. Thus, it should be apparent that a fence 90 provides a means for preventing movement of a support assembly from closed to open position when any leg section which comprises the support assembly is in its fully retracted position. Any degree of retraction of one or both of the upper leg sections 34', 34' will prevent movement of the support assembly 72 from closed to open position.

Referring now to FIG. 36 wherein the support assembly 72 is shown in open or set-up condition with the leg sections thereof in extended position. It should be noted that the fence 90 has been advanced from its position of FIG. 33 within the right cheek 87 of the pivot housing base 80 to a position wherein it extends through the slots 87, 87 and across the channel member in the path of downward movement of the plunger 48. It should now be apparent that the fences 90, 90 provide means for releasably retaining the upper leg sections 34', 34' in extended position in response to movement of the support assembly 72 to its open position when the upper leg sections are in open position and that the fences also provide means for preventing movement of the support assembly 72 from closed position to open position if either of the upper leg sections is not in its fully extended position.

Figure 41:
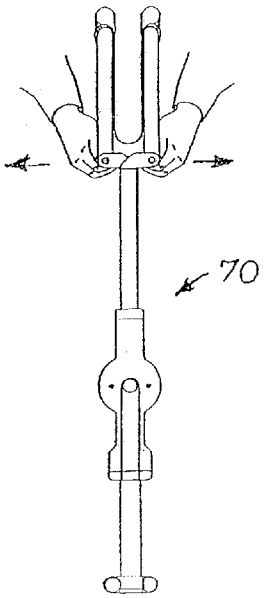
Figure 42:
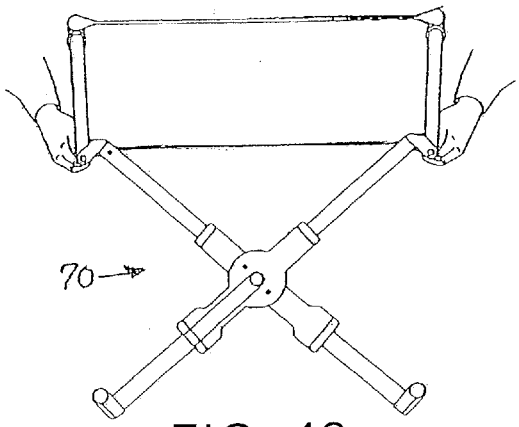
Figure 43:
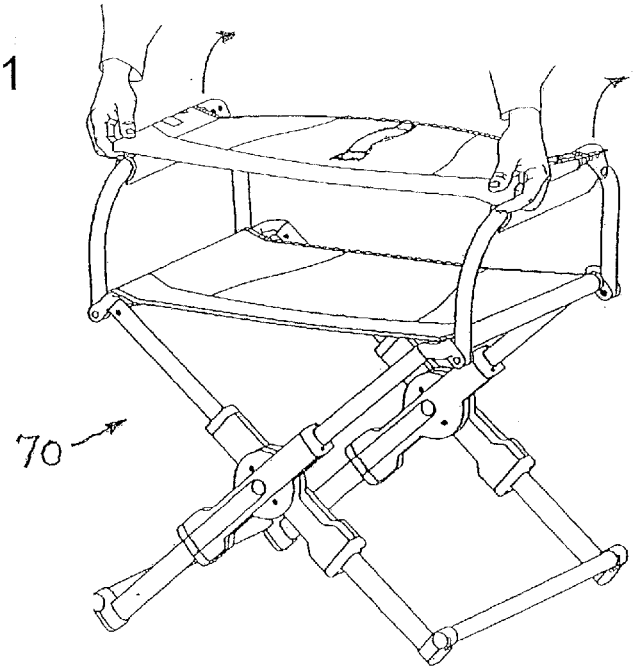
Figure 44:
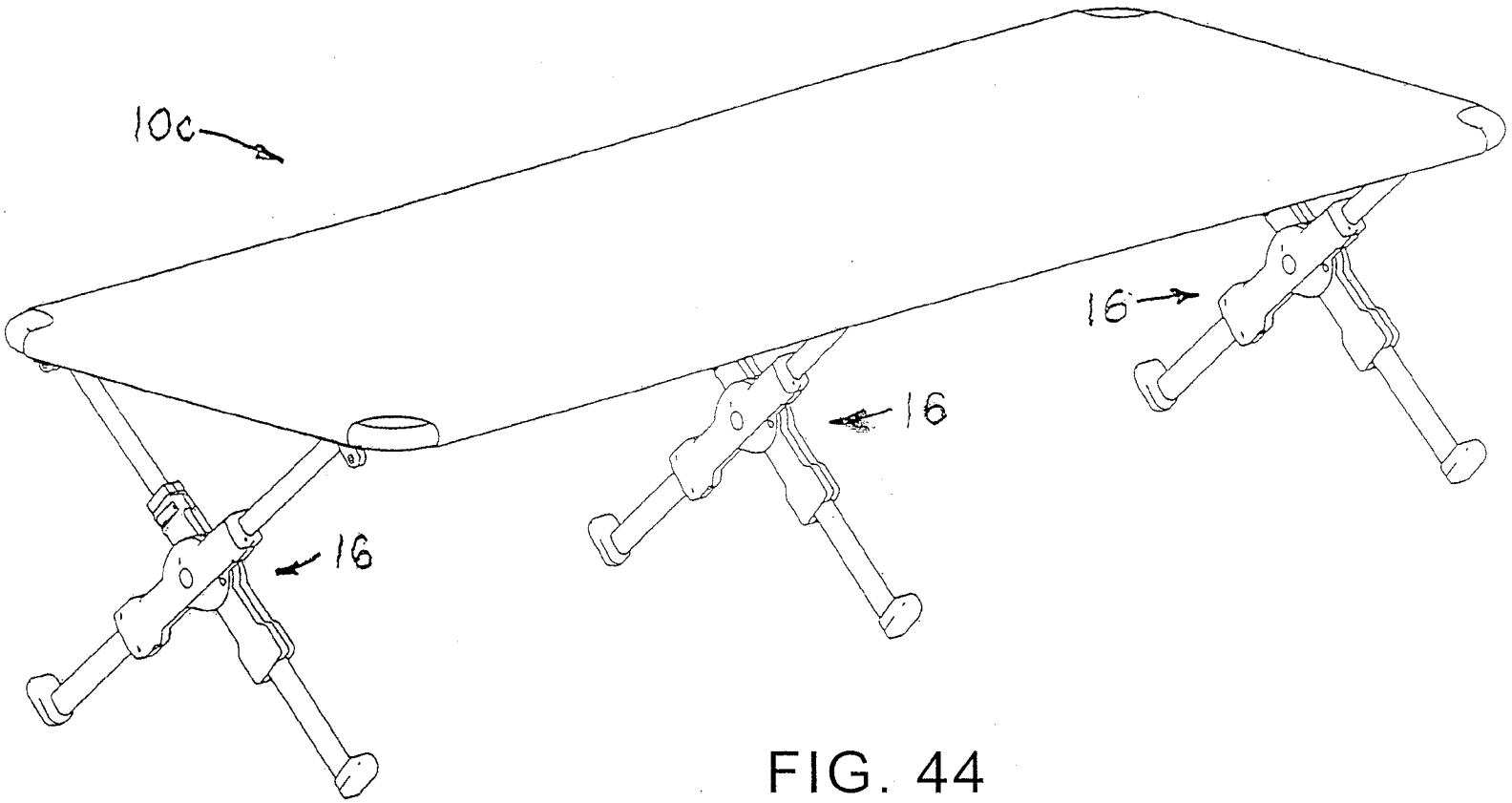
FIG. 44 is a perspective view of a cot embodying the present invention.

FIGS. 37-43 illustrate successive steps to be performed in setting up the arm chair illustrated in FIGS. 26-31. The collapsed chair should be placed upon the ground in the position shown in FIG. 37. Grasping the arm rests as shown, each arm rest is rotated outwardly and upwardly from its position of FIG. 37 to the position shown in FIG. 38. Keeping the hands in the position shown in FIG. 38, place one foot on both bottom connecting members as shown to hold the chair firmly on the ground. Lift the arm rest straight upward to move the leg sections from the retracted position shown in FIG. 39 to the extended leg position shown in FIG. 40. Grasp the seat support members as shown in FIG. 41 and pull outwardly in opposite directions to open the chair legs to the position shown in FIG. 42. Place hands on opposite sides of the back rest as shown in FIG. 43 and rotate the back rest upwardly and rearwardly to its upwardly extending position. The arm chair 70 will now be in set-up condition as it appears in FIG. 24.

Figure 30:
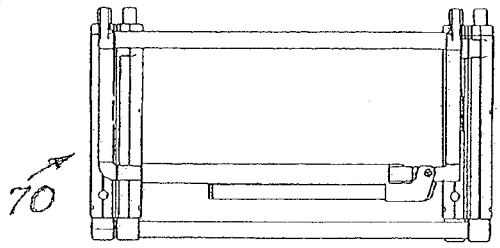
FIG. 30 is a side elevational view of the arm chair frame shown in collapsed condition.
Figure 31:
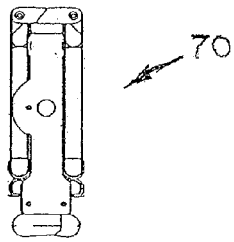
FIG. 31 is a front elevational view of the arm chair shown in collapsed condition.

A folding cot 10*c* having a collapsible mattress panel frame of conventional type may also be made in accordance with the invention utilizing three collapsible support assemblies 16, 16, as shown in FIG. 30.

Figure 45:
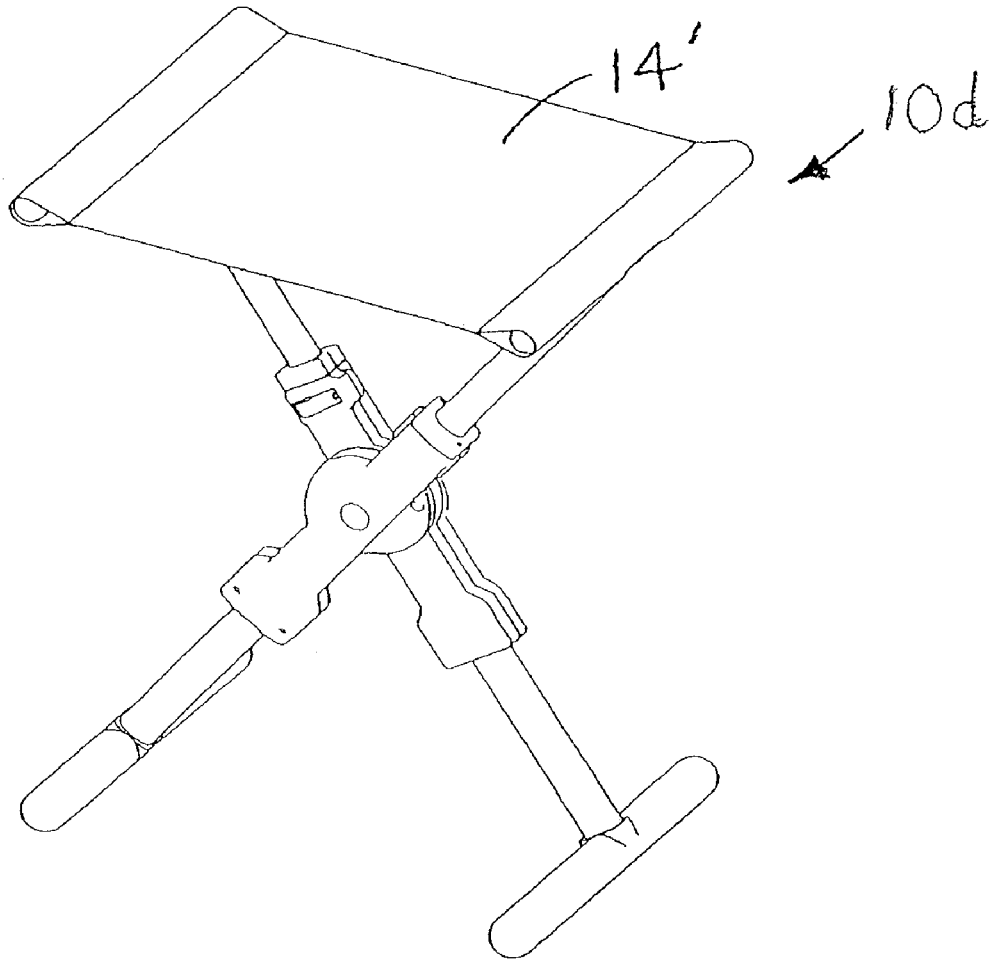
FIG. 45 is a perspective view of a soft-topped collapsible serving tray utilizing a single support assembly.

The present invention may also be practiced with an article of furniture or seat indicated at 10*d* and having a single support assembly 16, such as shown in FIG. 45. Cross members mounted in fixed position on the lower end of the lower leg section support the seat with the support assembly 12' in vertically oriented position. Similar cylindrical tubular cross members mounted in fixed position on the upper ends of the somewhat smaller upper leg section carry a generally rectangular horizontally disposed flexible seat panel 14'.

When the seat 10*d* is folded from its open to its closed position about the virtual axis A the cross members at the upper and lower ends of the leg assemblies come into engagement with each other before the leg assemblies can attain a fully closed position wherein the leg assemblies are in substantially parallel relation to each other. Hence the seat 10*d* illustrates the leg interference problem associated with folding chairs and seats of the prior art. However, as previously discussed, the button mechanisms associated with the upper leg sections attain released position within the last 20 degrees of angular movement toward closure. Thus, the seat 10*d* also shows that the present invention may be practiced with one or more support members having telescopic leg assemblies which do not achieve positions of substantial precise parallel alignment in closed position, general parallel alignment being sufficient for most applications.

There are or may be situations where it is desirable to produce an article of collapsible furniture which does not necessarily provide the optimum degree of collapsibility and portability. In such a situation, the present invention may be practiced with a collapsible frame utilizing a support assembly which includes a pivot assembly having two pivot housings each housing carrying an associated support member. Each of the members has two sections, one of the sections being fixed relative to its associated pivot housing and the other of the sections being collapsible, that is movable between extended and retracted position relative to its respective pivot housing. Such a support assembly is shown in FIGS. 46 and 47 and indicted generally by the reference numeral 100.

The support assembly 100 is similar in many respects to the support assembly 72 previously described with reference to the arm chair in that it has a pivot or hub assembly is substantially identical in its structural and operational characteristics to that of the previously described support assembly 72. Each of the two pivot housings which comprise the pivot assembly indicated at 102 carries an associated shut-off member or fence 90'. Each pivot housing has a lower leg section 30' which is mounted in fixed position within the housing and may, in fact, be supported within the housing by a metal sleeve which provides reinforcement for the housing. The upper or movable leg section is indicated at 34'. Each fence 90' is disposed within an associated cheek of the pivot housing when the support assembly is in its closed position of FIG. 46. When the upper or movable legs have been moved to fully extended position, as shown in FIG. 47, the support assembly may be angularly pivoted to its open position which positions the fence 90' in its securing position across the channel defined by the pivot housing. It should be noted that when each fence 90' is moved to its securing position with respect to the upper or telescopically movable leg section 34', it is located in the lower portion of its associated central hub so that the lower end of each movable upper section 34' engages the concave upwardly facing surface of a fence 90'.

Figure 46:
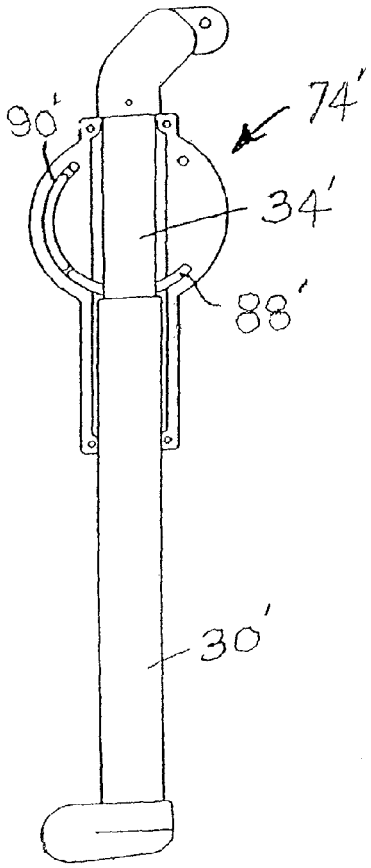
FIG. 46 is a front elevational view of another support assembly shown with a cover of one of the pivot housings removed and the upper leg section in retracted position.
Figure 47:
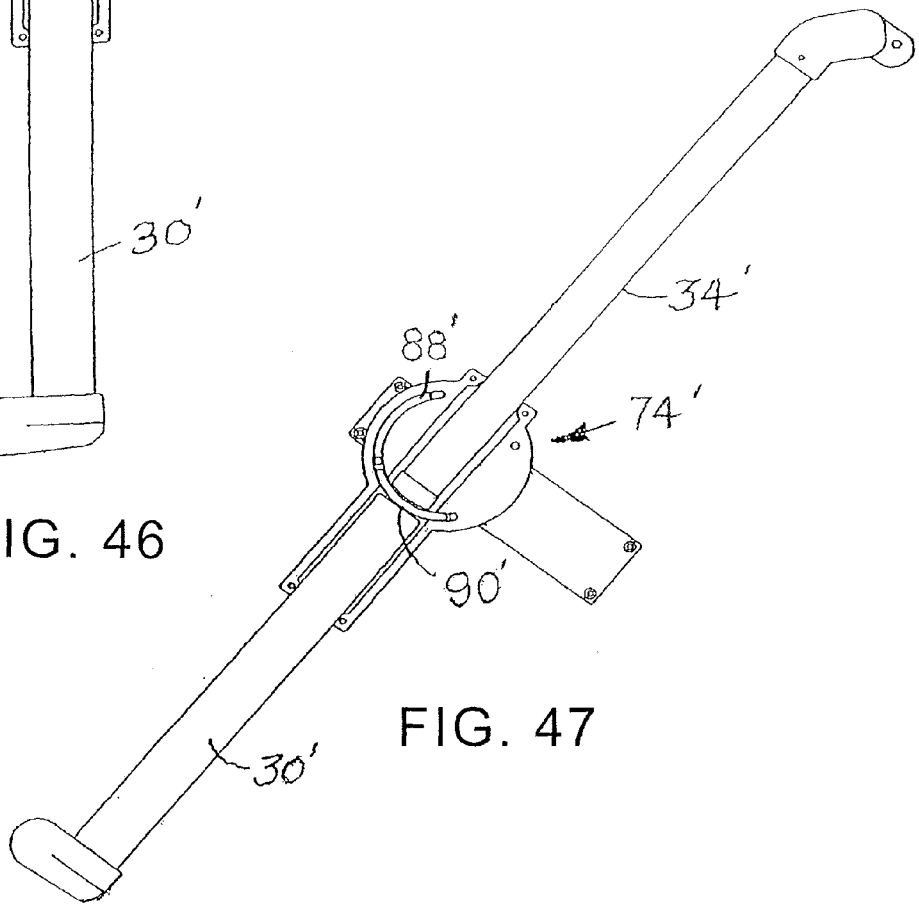
FIG. 47 is similar to FIG. 39 but shows the upper leg section secured in extended position.

Referring to FIG. 46, it will be noted that when the upper leg sections are in retracted position, as shown in FIG. 46, the sections are disposed in the paths of both fences that is the fence 90' that can be seen in FIG. 46 and the fence that cannot be fully seen provide means for preventing the pivot assembly from being angularly moved from its closed to its open position. As in the previously described embodiment, a tolerance of about 20° of angular movement is permitted in the opening direction before blockage occurs.

I claim:

1. Collapsible article of furniture comprising:

at least one collapsible support assembly having a pair of longitudinally elongated support members, said support members having a plurality of longitudinally extendable and retractable sections movable between extended and retracted positions relative to each other, means for enabling angular movement of said support members about an unintruding common axis in one and in an opposite angular direction relative to each other between closed and open positions, said support members in said closed position being longitudinally parallel to each other, said support members in said open position crossing each other at said unintruding common axis and presenting an X-shaped configuration, said extendable and retractable sections being freely movable through and transversely of said unintruding common axis in moving between said extended and retracted positions, and wherein said sections of each of said support members includes an upper section, said support assembly includes means for retaining said upper section of each of said support members in said extended position when said support members are in said open position, and said support assembly includes means for releasing said means for retaining said upper section of each of said support members when said support members move into said closed position.

2. Collapsible article of furniture as set forth in claim 1 wherein said unintruding common axis is at all times in fixed position relative to one of said sections of each of said support members.

3. Collapsible article of furniture as set forth in claim 1 wherein said unintruding common axis is further characterized as a virtual axis of rotation.

4. Collapsible article of furniture as set forth in claim 1 wherein said means for enabling comprises means for limiting angular movement of said support members relative to each other.

5. Collapsible article of furniture as set forth in claim 1 wherein said support assembly includes a hub assembly having a pair of hubs comprising said unintruding common axis and each of said support members is carried by an associated one of said hubs.

6. Collapsible article of furniture as set forth in claim 5 wherein said unintruding common axis comprises a pair of rivets mounted in fixed position on said hubs and constrained to travel within arcuate slots defined by said hubs.

7. Collapsible article of furniture as set forth in claim 1 wherein said support assembly has a hub assembly including a pair of hubs carrying said support members and a pivot pin coupling said hubs and comprising said enabling means.

8. Collapsible article of furniture as set forth in claim 7 wherein said pivot pin comprises a rivet coupling said hubs in face-to-face relation to each other between said support members.

9. Collapsible article of furniture as set forth in claim 1 wherein said sections are further characterized as telescopically connected sections.

10. Collapsible article of furniture as set forth in claim 1 wherein said support assembly includes a hub assembly having a pair of hubs and each of said support members has one section mounted in fixed position on an associated one of said hubs and at least another section substantially contained within said one section when said support members are in said retracted position.

11. Collapsible article of furniture as set forth in claim 10 wherein each of said support members includes a third section substantially contained within said one section thereof when said support members are in said retracted positions.

12. Collapsible article of furniture as set forth in claim 11 wherein said another section of each of said support members projects from and beyond one end of said one section and said third section projects from and beyond the opposite end of said one section when said support members are in said extended position.

13. Collapsible article of furniture as set forth in claim 1 wherein said support assembly includes means for retaining said extendable and retractable sections in said extended position when said support members are moved out of said closed position.

14. Collapsible article of furniture as set forth in claim 1 wherein said sections of each of said support members include an upper section and said support assembly includes means for retaining said upper section in said extended position when said upper section is withdrawn from its retracted position and moved longitudinally to its extended position.

15. Collapsible article of furniture as set forth in claim 1 wherein said means for retaining said upper section comprises a first detent carried by said upper section and biased outwardly therefrom and into engagement with another of said sections.

16. Collapsible article of furniture as set forth in claim 15 wherein said support assembly includes a pivot assembly having a pair of pivot housings and each of said housings carries an associated one of said support members, said means for releasing comprising a releasing member carried by each of said housings and exposed externally thereof for engaging the other of said housings and moving said first detent carried thereby out of engagement with said another of said sections.

17. Collapsible article of furniture as set forth in claim 1 wherein said sections of each of said support members include a lower section and said support assembly includes means for retaining said lower section in said extended position when said support members are moved beyond said closed position toward and to said open position.

18. Collapsible article of furniture as set forth in claim 7 wherein said support assembly includes a hub assembly having a pair of hubs, each of said support members is carried by an associated one of said hubs and said means for retaining said lower section comprises a second detent carried by said associated hub and biased inwardly and into engagement with said lower section.

19. Collapsible article of furniture as set forth in claim 18 wherein said support assembly includes means for releasing said means for retaining said lower section in said extended position.

20. Collapsible article of furniture as set forth in claim 1 wherein said article of furniture comprises a stool having at least two legs.

21. Collapsible article of furniture as set forth in claim 1 wherein said article of furniture comprises a chair having a folding back.

22. Collapsible article of furniture as set forth in claim 21 wherein said chair has a pair of individually collapsible arms.

23. Collapsible article of furniture as set forth in claim 1 wherein said article of furniture comprises a cot.

24. Collapsible article of furniture comprising:

an article frame having at least one support assembly including a pair of longitudinally extending and longitudinally collapsible support members each formed by a plurality of telescopically connected support sections including an upper support section, each of said support members having an extended position wherein at least one of said support sections extends from and beyond another of said support sections and a retracted position wherein said at least one of said support sections is substantially received within said another of said support sections, said at least one support assembly having a hub assembly including a pair of hubs, each of said support members mounted on an associated one of said hubs, said hubs being coupled in engagement with each other for limited angular movement relative to each other about a common unintruding axis of rotation intersecting said support members between opposite ends of said support members, said hubs being angularly movable about said axis between closed position wherein said support members are in substantially parallel relation to each other and open position wherein said support members cross each other at said axis and present a generally X-shaped configuration, each of said upper support sections being movable transversely of and beyond said axis in moving between said extended and retracted position, and said at least one support assembly having a pair of fences, each one of said fences being mounted in fixed position on an associated one of said hubs and extending through a slot defined by the other of said hubs, said fences being constructed and arranged to retain said upper support sections in said extended position when said support members are in said open position and to prevent movement of said support members to said open position when either of said upper support sections is not in said extended position.

25. Collapsible article of furniture as set forth in claim 24 wherein each of said support members include a tubular middle support section and a tubular lower support section, said middle support section has a lower end portion and an upper end portion, said lower support section is telescopically connected to said lower end portion and substantially received within said middle support section in said retracted position, said upper support section being telescopically connected to said upper end portion and substantially received within both said lower support section and said middle support section in said retracted position.

26. Collapsible article of furniture as set forth in claim 25 wherein said at least one support assembly includes a pair of spring biased detents, each one of said detents being mounted on an associated one of said hubs and biased inwardly through an aperture in an associated middle support section and through another aperture in an associated lower support section to retain the latter lower support section in said extended position, each of said upper support sections upon movement to its retracted position being engageable with an associated one of said detents to move said one of said detents to and maintain it in a releasing position to permit movement of said lower support sections to said retracted position.

27. Collapsible article of furniture comprising:

at least one collapsible support assembly having a pair of longitudinally elongated support members, each of said support members having a plurality of longitudinally extendable and retractable sections movable between extended and retracted positions relative to each other, means for enabling angular movement of said support members about an unintruding common axis in one and in an opposite angular direction relative to each other between closed and open positions, said support members in said closed position being longitudinally parallel to each other, said support members in said open position crossing each other at said unintruding common axis and presenting an X-shaped configuration, at least one of said sections being freely movable in a transverse direction relative to said axis in moving between said extended and retracted positions, and means for preventing each of said sections from moving from extended position when said support members are in said open position wherein said sections are movable to retracted position relative to each other in response to relative angular movement of said support members to said closed position.

28. Collapsible article of furniture as set forth in claim 27 wherein said means for retaining said upper section comprises means for releasing said upper section in response to movement of said support members to said closed position.

29. Collapsible article of furniture comprising:

at least one collapsible support assembly having a pair of longitudinally elongated support members, said support members having a plurality of longitudinally extendable and retractable sections movable between extended and retracted positions relative to each other, means for enabling angular movement of said support members about an unintruding common axis in one and in an opposite angular direction relative to each other between closed and open positions, said support members in said closed position being longitudinally parallel to each other, said support members in said open position crossing each other at said unintruding common axis and presenting an X-shaped configuration, said extendable and retractable sections being freely movable through and transversely of said unintruding common axis in moving between said extended and retracted positions, and wherein said sections of each of said support members include an upper section and said support assembly includes means for retaining said upper section in said extended position when said support members are in said open position.

30. Collapsible article of furniture comprising:

at least one collapsible support assembly having a hub assembly having a pair of hubs coupled in engagement with each other for angular movement relative to each other and a pair of longitudinally elongated support members, said support members having a plurality of longitudinally extendible and retractable sections movable between extended and retracted positions relative to each other, said support sections of each of said support members including an upper section, each of said hubs having an associated support member mounted thereon, means for enabling angular movement of said hubs with said support members mounted thereon about an unintruding common axis of rotation in one and in an opposite angular direction between closed and open positions, said support members in said closed position being longitudinally parallel to each other, said support members in said open position presenting a generally X-shaped configuration, each of said upper sections being movable in a transverse direction relative to said unintruding common axis of rotation, and said at least one support assembly having a pair of fences, each of said fences being mounted in fixed position on an associated one of said hubs and extending through a slot defined by the other of said hubs, said fences being constructed and arranged to retain said upper support sections in said extended position when said support members are in said open position and to prevent movement of said support members to said open position when at least one of said upper support sections is not in said extended position.

31. Collapsible article of furniture as set forth in claim 30 wherein each of said fences comprises an arcuate fence including a concave surface and each of said upper support members has a lower end engageable with said concave surface of an associated fence when said upper support member is in said extended position.

32. Collapsible article of furniture as set forth in claim 30 wherein each of said support members has a tubular lower support section which telescopically receives an associated upper support section therein when said support members are moved to said retracted position.

* * * * *